US011415274B2

(12) United States Patent
Shao

(10) Patent No.: US 11,415,274 B2
(45) Date of Patent: Aug. 16, 2022

(54) DUAL-COLOR LIGHT EMITTING DIODE LIGHT STRINGS

(71) Applicant: Blooming International Limited, British West Indies (AI)

(72) Inventor: Shu-Fa Shao, Taipei (TW)

(73) Assignee: Blooming International Limited, British West Indies (AI)

( * ) Notice: Subject to any disclaimer, the term of this patent is extended or adjusted under 35 U.S.C. 154(b) by 0 days.

(21) Appl. No.: 17/217,083

(22) Filed: Mar. 30, 2021

(65) Prior Publication Data

US 2021/0396363 A1 Dec. 23, 2021

Related U.S. Application Data

(63) Continuation of application No. 16/298,935, filed on Mar. 11, 2019, now Pat. No. 10,989,371.
(Continued)

(30) Foreign Application Priority Data

Mar. 9, 2018 (CN) ..... 201810195592.5

(51) Int. Cl.
*F21S 4/00* (2016.01)
*F21V 23/00* (2015.01)
(Continued)

(52) U.S. Cl.
CPC ..... *F21S 4/00* (2013.01); *F21V 19/0025* (2013.01); *F21V 23/001* (2013.01);
(Continued)

(58) Field of Classification Search
None
See application file for complete search history.

(56) References Cited

U.S. PATENT DOCUMENTS 2,935,599 A * 5/1960 Price, Jr. ..... F21S 4/10 362/382
4,675,575 A 6/1987 Smith et al.
(Continued)

FOREIGN PATENT DOCUMENTS

CA 2 655 486 A1 9/2009
CN 200982547 Y 11/2007
(Continued)

OTHER PUBLICATIONS

U.S. Appl. No. 16/298,935, filed Mar. 11, 2019, Inventor Shu-Fa Shao.
(Continued)

*Primary Examiner* — Britt D Hanley
(74) *Attorney, Agent, or Firm* — Christensen, Fonder, Dardi & Herbert PLLC

(57) ABSTRACT

A light string, comprising a first illumination device configured to emit a first color light; a second illumination device adjacent the first illumination device, and configured to emit a second color light, the second color being different from the first; a first wire including a first conductor and a first insulating layer, the first conductor partially exposed to form a first conductor soldering section; and a second wire, including a second conductor and a second insulating layer, the second conductor partially exposed to form a second conductor soldering section. The first conductor soldering section and the second conductor soldering section are attached to a pair of electrical contacts on each of the first and second illumination devices, and the first and second illumination devices are electrically biased such that either the first illumination device emits light or the second illumination device emits light, but not both at the same time.

16 Claims, 16 Drawing Sheets

Related U.S. Application Data

(60) Provisional application No. 62/682,683, filed on Jun. 8, 2018.

(51) Int. Cl.
*F21V 19/00* (2006.01)
*F21Y 113/13* (2016.01)
*F21Y 115/10* (2016.01)

(52) U.S. Cl.
CPC ..... *F21V 23/003* (2013.01); *F21Y 2113/13* (2016.08); *F21Y 2115/10* (2016.08)

(56) References Cited

U.S. PATENT DOCUMENTS 4,761,720 A 8/1988 Solow
4,812,956 A 3/1989 Chen
4,908,743 A 3/1990 Miller
5,109,324 A 4/1992 Ahroni
5,150,964 A 9/1992 Tsui
5,747,940 A 5/1998 Openiano
5,834,901 A 11/1998 Shen
6,091,204 A 7/2000 Chen
6,113,248 A 9/2000 Mistopoulos et al.
6,367,952 B1 4/2002 Gibboney, Jr.
6,582,094 B2 6/2003 Liu
6,592,238 B2 7/2003 Cleaver et al.
6,604,841 B2 8/2003 Liu
6,609,814 B2 8/2003 Ahroni
6,777,891 B2 8/2004 Lys et al.
6,914,194 B2 7/2005 Fan
7,088,904 B2 8/2006 Ryan, Jr.
7,131,748 B2 11/2006 Kazar et al.
7,160,140 B1 1/2007 Mrakovich et al.
7,186,005 B2 3/2007 Hulse
7,235,815 B2 6/2007 Wang
7,253,566 B2 8/2007 Lys et al.
7,926,978 B2 4/2011 Tsai
8,076,872 B2 12/2011 Sauerlander
8,203,275 B2 6/2012 Ruxton
8,371,716 B2 2/2013 Shen et al.
8,397,381 B2 3/2013 Tsai
8,469,750 B2 6/2013 Chen
8,562,175 B2 10/2013 Chen
8,568,015 B2 10/2013 Chen
8,592,845 B2 11/2013 Chen
8,608,342 B2 * 12/2013 Chen ..... H01R 4/2433 362/249.06
8,641,229 B2 2/2014 Li
8,680,773 B2 3/2014 Hering et al.
8,853,721 B2 10/2014 Chen
9,055,777 B2 6/2015 Chen
9,060,409 B2 6/2015 Bowers et al.
9,279,551 B2 3/2016 Vissenberg et al.
9,291,318 B1 3/2016 Benson
9,635,722 B1 * 4/2017 Cao ..... H05B 45/40
9,655,211 B2 5/2017 Altamura et al.
9,788,384 B1 10/2017 Harris
9,887,501 B2 2/2018 Chen
9,907,136 B2 2/2018 Leung et al.
9,939,117 B1 4/2018 Peng
10,006,596 B2 6/2018 Yu et al.
10,123,387 B2 11/2018 Lai
10,136,497 B2 11/2018 Harris
10,178,887 B1 1/2019 Chen
10,184,654 B1 1/2019 Chen
10,205,073 B2 2/2019 Altamura
10,288,235 B1 5/2019 Chen
10,288,236 B1 5/2019 Chen
10,578,260 B1 3/2020 Chen
10,663,123 B2 5/2020 Plavnicky
10,697,598 B1 6/2020 Chen et al.
2002/0027778 A1 3/2002 Ko
2003/0063463 A1 4/2003 Sloan et al.
2004/0246718 A1 12/2004 Fan
2006/0221609 A1 10/2006 Ryan, Jr.
2007/0015396 A1 1/2007 Mrakovich et al.
2008/0084702 A1 4/2008 Cheung
2008/0094828 A1 4/2008 Shao
2009/0154156 A1 6/2009 Lo et al.
2009/0284159 A1 * 11/2009 Yang ..... F21S 4/10 315/185 S
2009/0302771 A1 12/2009 Peng
2010/0001664 A1 1/2010 Shih
2010/0141161 A1 6/2010 Hering et al.
2010/0157598 A1 6/2010 Tsai
2010/0265703 A1 * 10/2010 Hall ..... F21K 9/62 362/231
2010/0277084 A1 11/2010 Lee
2011/0062875 A1 3/2011 Altamura
2011/0210677 A1 9/2011 Hering et al.
2011/0215368 A1 9/2011 Chen
2011/0228535 A1 * 9/2011 Shao ..... H05B 33/06 362/249.02
2011/0286223 A1 11/2011 Chen
2011/0303939 A1 12/2011 Chen
2011/0305022 A1 * 12/2011 Chen ..... H01L 23/495 362/249.06
2011/0310601 A1 * 12/2011 Shao ..... G09F 13/22 362/231
2012/0039070 A1 2/2012 Shen et al.
2012/0075863 A1 3/2012 Chen
2012/0275157 A1 11/2012 Hsu
2013/0078847 A1 3/2013 Chen
2013/0107514 A1 5/2013 McNabb et al.
2013/0301246 A1 11/2013 Chen
2014/0268728 A1 * 9/2014 Hussell ..... F21K 9/90 362/225
2014/0355277 A1 12/2014 Lin
2015/0008835 A1 1/2015 Sugiura et al.
2016/0183338 A1 6/2016 Loomis
2016/0186940 A1 6/2016 Del Castillo et al.
2016/0341408 A1 11/2016 Altamura
2017/0023223 A1 1/2017 Tsai
2017/0038055 A1 2/2017 Daniels
2017/0108185 A1 * 4/2017 He ..... F21S 4/10
2017/0206813 A1 * 7/2017 Huang ..... F21V 31/04
2017/0295622 A1 10/2017 Harris
2017/0343170 A1 11/2017 Yu et al.
2018/0020519 A1 1/2018 Harris
2018/0020520 A1 1/2018 Harris
2018/0035800 A1 * 2/2018 Okeke ..... A47B 13/16
2018/0172225 A1 6/2018 Zhao
2018/0172226 A1 6/2018 Zhao
2018/0187840 A1 * 7/2018 Chen ..... H01B 1/026
2018/0299084 A1 10/2018 Chien
2019/0053348 A1 2/2019 Harris
2019/0078767 A1 3/2019 Loomis
2019/0234597 A1 8/2019 Zhu
2019/0277458 A1 9/2019 Shao
2019/0326711 A1 * 10/2019 McRae ..... H01R 13/6666
2019/0335559 A1 10/2019 Shao
2020/0236746 A1 7/2020 Shao
2020/0278091 A1 * 9/2020 Chen ..... F21S 4/20
2021/0071828 A1 * 3/2021 Shan ..... F21S 4/10

FOREIGN PATENT DOCUMENTS

CN 201121811 Y 9/2008
CN 201897194 U 7/2011
CN 201898147 U 7/2011
CN 201966240 U 9/2011
CN 202613183 U 12/2012
CN 103594907 A 2/2014
CN 203703878 U 7/2014
CN 107069577 A 8/2017
CN 206389071 U 8/2017
DE 202016104159 U1 * 9/2016 ..... F21S 4/00
DE 212017000017 U1 * 2/2018 ..... F21S 4/26
GB 2 454 546 A 5/2009

(56) References Cited

FOREIGN PATENT DOCUMENTS

| | | | | |
|---|---|---|---|---|
| JP | 3131410 U | * | 5/2007 | ..... F21S 4/00 |
| NL | 7506800 A | | 12/1976 | |

OTHER PUBLICATIONS

U.S. Appl. No. 16/653,514, filed Oct. 15, 2019, Inventor Shu-Fa Shao.
U.S. Appl. No. 16/573,880, filed Sep. 17, 2019, Inventor Shu-Fa Shao.
U.S. Appl. No. 16/219,657, filed Dec. 13, 2018, Inventor Johnny Chen.
U.S. Appl. No. 16/547,377, filed Aug. 21, 2019, Inventor Shu-Fa Shao.
U.S. Appl. No. 16/185,467, filed Nov. 9, 2018, Inventor Shu-Fa Shao.
U.S. Appl. No. 62/598,288, filed Dec. 13, 2017, Inventor Johnny Chen.
U.S. Appl. No. 16/573,890, filed Sep. 17, 2019, Inventor Shu-Fa Shao.
U.S. Appl. No. 16/405,824, filed May 7, 2019, Inventor Shu-Fa Shao.

* cited by examiner

DUAL-COLOR LIGHT EMITTING DIODE LIGHT STRINGS

PRIORITY CLAIM

The present application is a continuation of U.S. application Ser. No. 16/298,935, filed Mar. 11, 2019, which claims the benefit of U.S. Provisional Application No. 62/682,683, filed Jun. 8, 2018, and also claims priority to Chinese Patent Application No. 201810195592.5, filed Mar. 9, 2018, which are incorporated herein by reference in their entireties.

FIELD OF THE INVENTION

The instant disclosure relates to decorative light strings, and in particular, relates to light strings, circuits of light strings, and methods of manufacturing light strings.

BACKGROUND OF THE INVENTION

A light string that includes plural light sources directly soldered onto electric conductors at intervals, so as to form a string-shaped illumination device without a lamp holder, is known in the art. An example of such a light string is found in U.S. Pat. No. 8,397,381, entitled Method of Manufacturing Light Set with Surface Mounted Light Emitting Components. Light strings having many small-sized light sources, such as small bulbs that include light emitting diodes (LEDs), are commonly known. A light string is as flexible as the electric wire is, such that the light string is easily arranged in any configuration to comply with requirements for special illumination or decoration.

In the art, light sources are soldered to the copper core or conductor after the insulating layer of the electric wire or wire is removed, and then an electrical insulating treatment is performed on the solder joints. In this approach, light sources obviously stick out on the electric wire and are configured to have high-directivity. When arranging a light string, which may include pulling the light string, the light sources may be subject to forces and shocks that result in solder joints cracking. Furthermore, usually electric wires are flexible, but the soldering material is not as flexible. Thus, when the electric wire of the light string is pulled or bent, stress concentration often occurs at the soldering joints and results in soldering joints cracking.

In addition, in a light string, light sources are typically electrically connected in series or electrically connected in parallel. In parallel, precise driving voltage is required to drive the light source and prevent the light sources from being damaged by over-current. In a series connection, the number of the light sources is determined by the output voltage of the power source, with the number and type of light source being selected to ensure that every light source is driven by an appropriate voltage with an allowable voltage difference. This means that the number of the light sources is restricted by the output of the power source such that the number cannot be changed at will. Meanwhile, one damaged light can result in failure of the whole light string.

SUMMARY OF THE INVENTION

The present disclosure provides embodiments of light strings, systems and circuits thereof, as well as methods of manufacturing light strings, that present an improvement over known light strings and related systems, circuits, and methods of manufacturing.

According to an embodiment of the present disclosure, a light string includes at least one illumination device, a first wire and a second wire.

The illumination device includes a substrate and a light source; wherein the substrate includes a carrier portion and two soldering portions, the carrier portion is located between the two soldering portions, and the light source is disposed on the carrier portion. The first wire includes a first conductor, which may comprise one or more conductive strands, and a first insulating layer; wherein the first insulating layer wraps around the first conductor and the first conductor is partially exposed to form at least one first soldering section. The second wire includes a second conductor and a second insulating layer; wherein the second insulating layer wraps around the second conductor, and the second conductor is partially exposed to form at least one second soldering section. The first soldering section and the second soldering section are attached to the two soldering portions of the substrate respectively; and the light source is located between the first soldering section and the second soldering section. The soldering material is disposed onto the two soldering portions and at least partially covers the first soldering section and the second soldering section, so as to attach the first soldering section and the second soldering section to the two soldering portions respectively. In an embodiment, a transparent covering, such as an adhesive, which may be glue, covers the illumination device, the first soldering section and the second soldering section, and extends to partially cover the first insulating layer and the second insulating layer. In an embodiment, the transparent glue has a largest cross-sectional area corresponding to the light source, and the cross-sectional area of the transparent glue shrinks gradually along a direction toward the first insulating layer and the second insulating layer.

According to another embodiment of the present disclosure, a circuit of the light string includes a first wire, a second wire, and a plurality of illumination devices.

Each of the illumination devices includes a substrate and a light source. The substrate includes a carrier portion, an anode soldering portion and a cathode soldering portion, the carrier portion is located between the anode soldering portion and the cathode soldering portion, and the light source is disposed on the carrier portion and electrically connected to the anode soldering portion and the cathode soldering portion. The illumination devices are electrically connected to the first wire and the second wire by the anode soldering portions and the cathode soldering portions.

In an embodiment, the light string comprises a dual-color, color-changing light string. In such an embodiment, the dual-color, color-changing light string includes a plurality of pairs of illumination devices, each pair having a first LED capable of emitting a first color, and a second LED capable of emitting a second color. The first illumination device and second illumination device are located adjacent one another, with the cathode of the first illumination device and the anode of the second illumination device both soldered to an exposed section of a first wire, and the anode of the first illumination device and the cathode of the second illumination device both soldered to an exposed section of a section of another wire. In such a configuration, the first illumination device and the second illumination device are connected to the first and second wires in an opposite polarity. Consequently, depending on the voltage polarity provided by a controller, either the first LED or the second LED will operate and emit light, hence the light string can change colors. In an embodiment, the first illumination device and the second illumination device are commonly covered with a transparent covering to form a dual-color illumination assembly that may be powered to emit light of either the first color or the second color.

In an embodiment, one that may be best suited for placement on structures allowing an unobstructed view of the light string, both the first and the second illumination devices are positioned relative to the first and second wire such that light emitted from the LEDs of the illumination devices is directed generally away from, or in a direction transverse to a lengthwise axis of the first and second wires. In one such embodiment, the illumination devices include soldering portions on the sides of the substrates that contact soldering sections of the first and second wires. In another such embodiment, the illumination devices include soldering portions on the tops of the substrates that contact soldering sections of the first and second wires.

In another embodiment of a dual-color light string, one that may be best suited for placement on artificial trees, or even live outdoor trees, bushes and shrubs, both the first and the second illumination devices are positioned relative to the first and second wire such that light emitted from the LEDs of the illumination devices is directed toward the wire insulation in a direction parallel to a lengthwise axis of the first and second wires. Directing the light through the transparent covering and toward the wires creates a unique lighting effect as it refracts and reflects off of the various structures that may include the wire insulation, wire conductors, solder joints (depending on the embodiment), and the transparent covering.

According to yet another embodiment of the present disclosure, a circuit of a light string includes a first wire, a second wire, a plurality of illumination devices, and a third wire.

In an embodiment, each of the illumination devices includes a substrate, a light source and a controller; wherein the substrate includes a carrier portion, an anode soldering portion and a cathode soldering portion, the carrier portion is located between the anode soldering portion and the cathode soldering portion, and the light source is disposed on the carrier portion, and electrically connected to the anode soldering portion and the cathode soldering portion; the controller is combined with the substrate for enabling and disabling the light source, and the controller includes a signal-input terminal and a signal-output terminal; and each of the illumination devices are electrically connected to the first wire by the anode soldering portions, and electrically connected to the second wire by the cathode soldering portions. The third wire includes a signal-input end and a signal-output end, and a plurality of cut-off points are arranged on the third wire. Each of the illumination devices is disposed at one of the cut-off points respectively, and the signal input terminal and the signal output terminal are electrically connected to the third wire respectively via different sides of the corresponding cut-off point. The third wire receives a control signal from the signal input end, and transfers the control signal to each of the controllers via the signal input terminals to control the corresponding light source, and the control signal is transferred to the controller of the next illumination device via the signal output terminals.

In the present disclosure, the illumination devices are securely soldered between the first wire and the second wire, and provide good illumination effects. Moreover, embodiments of circuits of light strings in the present disclosure provide a variety of approaches to supplying power, adopt various types of light source, and ensure that every light source can receives acceptable power input to prevent under voltage resulting from too many light sources.

BRIEF DESCRIPTION OF THE DRAWINGS

The present invention will become more fully understood from the detailed description given herein below for illustration only, and thus not limitative of the present invention, wherein.

DETAILED DESCRIPTION

Figure 1:
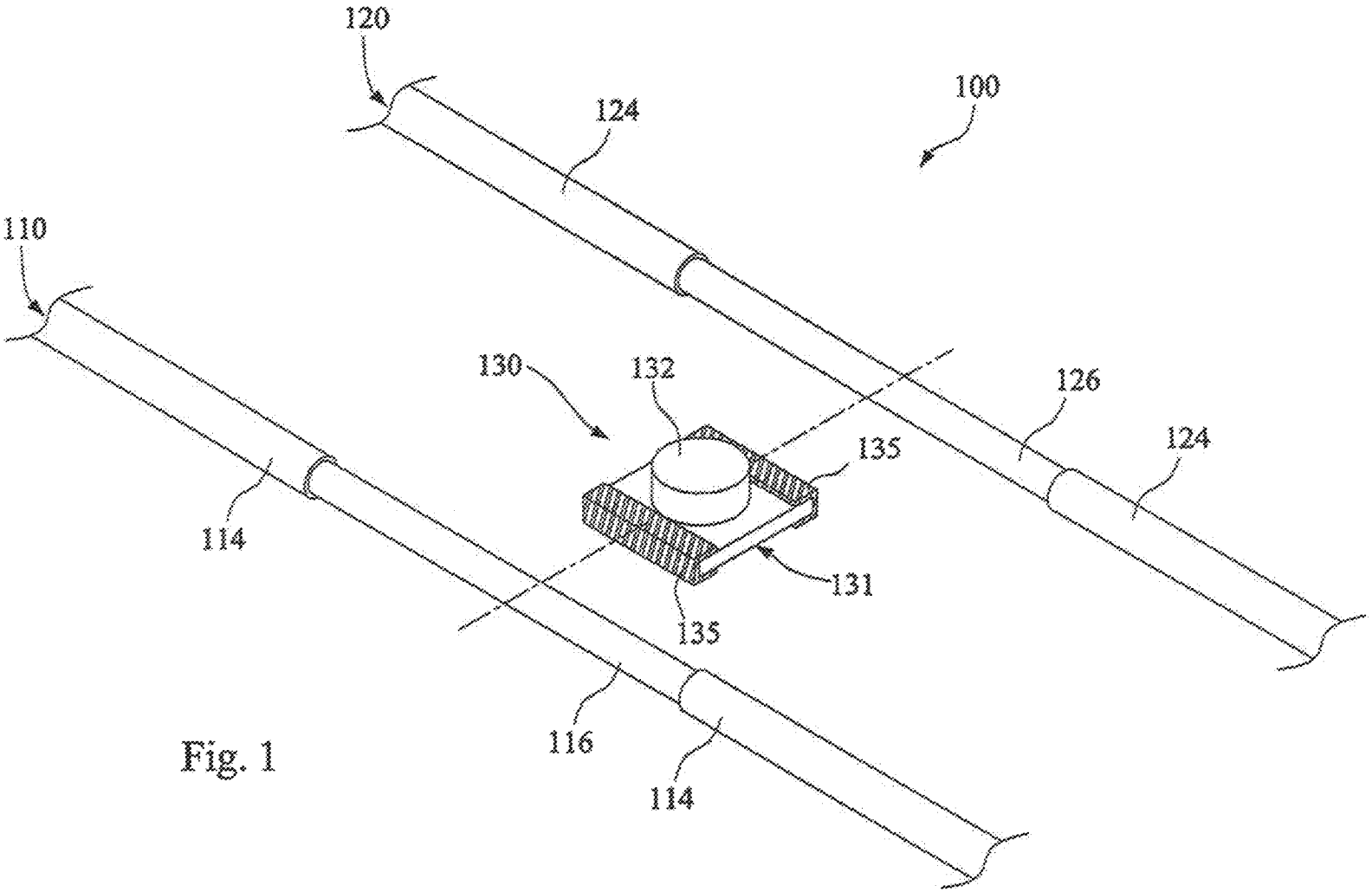
FIG. 1 is an exploded view of a first wire, a second wire and an illumination device, according to a first embodiment of the present disclosure.
Figure 2:
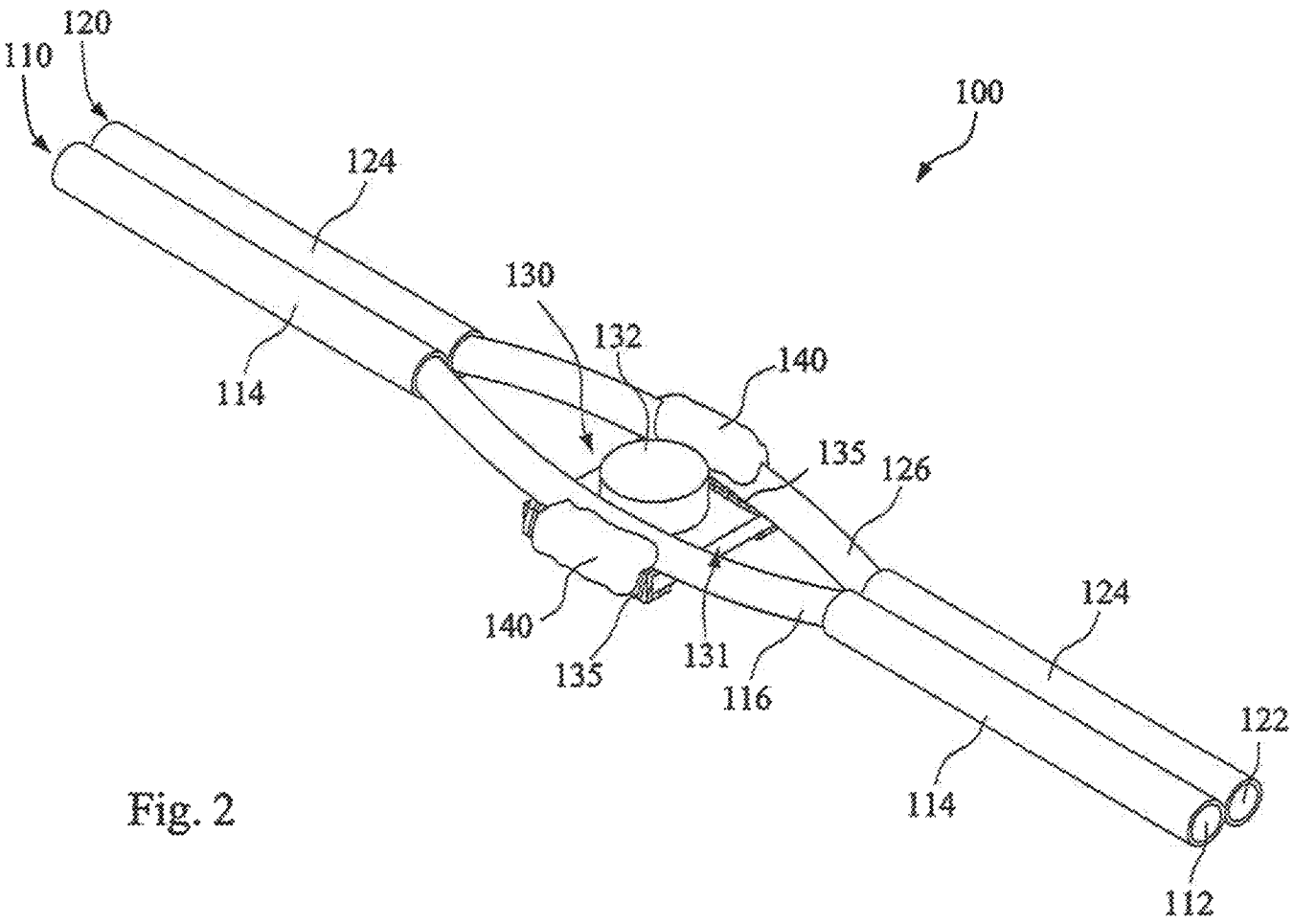
FIG. 2 is a three-dimensional view of the first wire, the second wire and the illumination device combined together, according to the first embodiment of the present disclosure.
Figure 3:
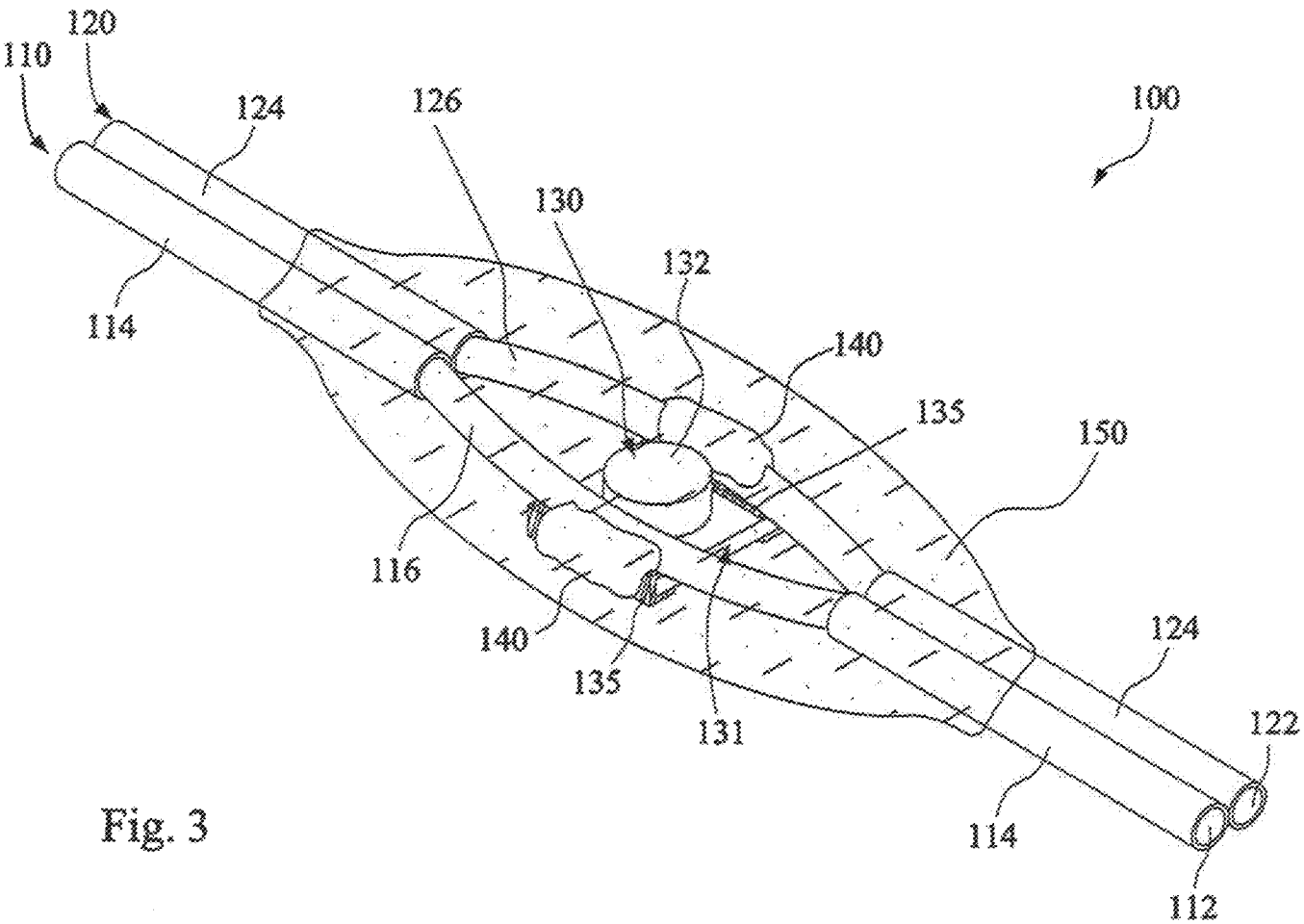
FIG. 3 is a three-dimensional view of a light string, according to the first embodiment of the present disclosure.

Referring to FIG. 1, FIG. 2 and FIG. 3, a light string 100 includes one or more illumination devices 130, a first wire 110, a second wire 120, soldering material 140 and transparent adhesive 150.

Referring to FIGS. 1-4, although only one illumination device 130 is illustrated in the drawings, the light string 100 in the present disclosure can be equipped with two or more than two illumination devices 130 and disposed between the first wire 110 and the second wire 120 in parallel.

Each of the illumination devices 130 includes a substrate 131 and a light source 132. The substrate 131 includes a carrier portion 133 and two soldering portions 134 (also referred to herein as electrical terminals or contacts). The carrier portion 133 is located between the two soldering portions 134, and the light source 132 is disposed on the carrier portion 133.

At least the surface of each of the soldering portions 134 is comprised of a conductive material 135 and respectively connected to the light source 132. In one example, a metal layer is plated on each of the soldering portions 134, to serves as the conductive material 135. In another example, each of the soldering portions 134 is made of metal, and the substrate 131 is formed by joining the insulation part (the carrier portion 133) and the conductive part (the soldering portions 134).

Figure 4:
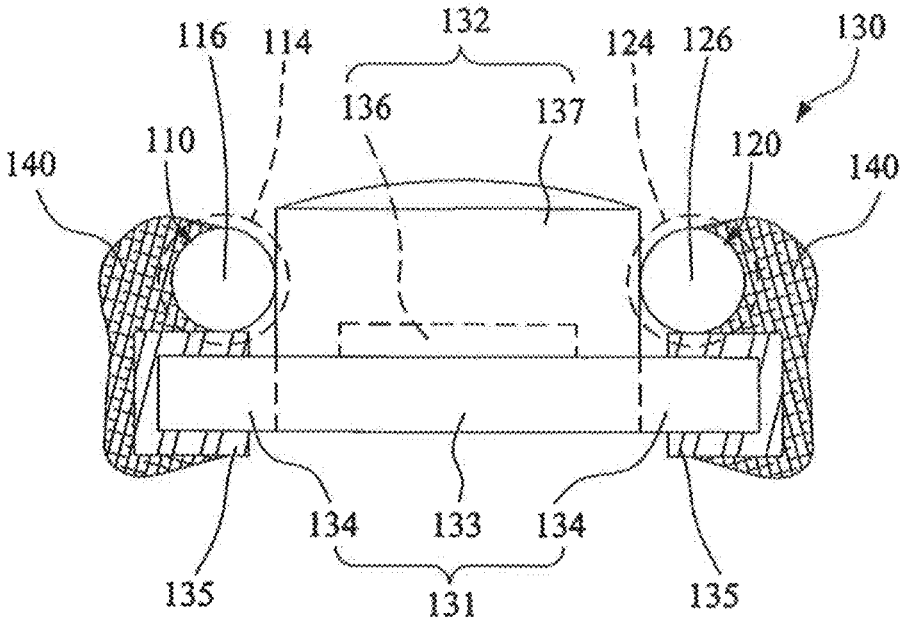
FIG. 4 is a cross-sectional view of the first wire, the second wire and the illumination device combined together according to the first embodiment of the present disclosure.

Referring to FIG. 4, the light source 132 further includes a light-emitting component 136 and a transparent package body 137. The light-emitting component 136 is disposed on the carrier portion 133 of the substrate 131, and the transparent package body 137 covers the light-emitting component 136.

In one example, the illumination device 130 is a surface-mount technology light-emitting diode (SMT LED), also known in the art as a surface-mount device (SMD) LED. The light-emitting component 136 comprises a light-emitting diode chip. The substrate 131, in an embodiment, in an embodiment, is a sapphire substrate. The transparent package body 137, in an embodiment, is composed of solidified glue or adhesive, wherein liquid glue is dispensed on the light-emitting diode chip and solidified to form the transparent package body 137. A convex portion is formed on the upper surface of the transparent package body 137 to increase the beam angle and the brightness of illumination. In an embodiment, the liquid glue is a resin encapsulation glue containing phosphor, and the proportion of phosphor to the rest of the liquid glue determines the fluidity of the liquid glue and the curvature of the convex.

Referring to FIG. 1, FIG. 2 and FIG. 4, the first wire 110 includes a first conductor 112 and a first insulating layer 114. In an embodiment, conductor 112 comprises a single strand conductor, and in other embodiments, comprises multiple strands, which may be twisted about one another. The first insulating layer 114 wraps around the first conductor 112, and the first conductor 112 is partially exposed to form at least one first conductor soldering section 116. During a manufacturing process, first soldering section 112 and second soldering section 116 may be formed in a variety of ways. In an embodiment, an axial (lengthwise) pull force or tension is applied to wires 100 and 120, then a portion of insulating layers 114 and 124 are cut, in some cases circumferentially, without cutting the conductors, causing portions of the insulating layers 114 and 124 to move axially along the respective conductors, exposing a portion of the conductors of the wires, thereby creating first soldering section 112 and second soldering section 116. In an embodiment, the number of first soldering sections 116 is equal to the number of the illumination devices 130.

As shown in FIG. 1, FIG. 2 and FIG. 4, the second wire 120 includes a second conductor 122 and a second insulating layer 124. The second insulating layer 124 wraps around the second conductor 122, and the second conductor 122 is partially exposed to form at least one second soldering section 126. In an embodiment, the number of second soldering sections 126 is equal to the number of illumination devices 130, and each first soldering section 116 is paired with a second soldering section 126.

In an embodiment, wires 110 and 120 may comprise two separate, unjoined wires. However, in another embodiment, wires 110 and 120 may be joined together. In such an embodiment, wires 110 and 120 may be joined by a common insulation layer that is extruded over the conductors, with little or no gap therebetween. In other embodiments, two separate wires 110 and 120 may be joined by other mechanical means, such as fasteners or adhesives.

In an embodiment, and as shown in FIG. 2 and FIG. 4, the first soldering section 116 and the second soldering section 126 are attached to the two soldering portions 131 of the substrate 134 respectively, and the light source 132 is disposed between the first soldering section 116 and the second soldering section 126, such that the first soldering section 116 and the second soldering section 126 hold the illumination device 130 and its light source 132 in a clamping manner. In such an embodiment, wires 110 and 120 impart a retaining force in a direction perpendicular to a lengthwise axis of the wires, on illumination devices 130, which aids in retaining each illumination device 130 in contact with soldering sections 116 and 126.

As shown in the drawings, the soldering material 140 is disposed onto the two soldering portions 134 and partially covers the first soldering section and the second soldering section, to attach the first soldering section 116 and the second soldering section 126 to the two soldering portions 134 respectively. In an embodiment, to prevent solder joints on the first soldering section 116 and the second soldering section 126 from cracking, the soldering material 140 further extends to cover a lateral edge and a back surface of the substrate 131, and surfaces of the lateral edge and the back surface are comprised of the conductive material 135 as well. Such a method of soldering causes conductive joining of a greater conductive area of the soldering sections of the conductors of the wire, and a larger conductive area of the soldering portions of the illumination device. The result is a stronger mechanical bond, which results in a higher quality, more durable light set, and also avoids known non-wetting issues that may arise in solder joints accomplished by other manufacturing methods.

As shown in FIG. 1 and FIG. 2, in an embodiment, the transparent adhesive or glue layer 150 covers the illumination device 130, the first soldering section 116 and the second soldering section 126, and further extends to partially cover the first insulating layer 114 and the second insulating layer 124. The transparent glue 150 has a largest cross-sectional area at a location corresponding to the light source 132.

The cross-sectional area of the transparent glue 150 shrinks gradually in diameter along directions toward the first insulating layer 114 and the second insulating layer 124. That is, the transparent glue bulk 150 not only covers the illumination device 130, the first soldering section 116 and the second soldering section 126, but also covers the sections of the first second insulating layer 114 and the second insulating layer 124 which are adjacent to the transparent glue layer 150.

The material of the transparent adhesive 150 can comprise rapid solidification glue such as a UV cure adhesive. During manufacture, liquid glue is dispensed onto the light source 132 by a glue dispenser, and then the liquid glue flows over the top of the light source 132 and into the adjacent sections of the first insulating layer 114 and second insulating layer 124.

Referring FIG. 4, the transparent glue 150 extends to partially cover the first insulating layer 114 and the second insulating layer 124. In an embodiment, the transparent glue 150 when solidified is tough and may have a hardness higher than a hardness of any portion of the first wire 110 or the second wire 120. Therefore, when the first wire 110 or the second wire 120 is bent for arrange the light string 100, the section of the first wire 110 or the second wire 120 equipped with the illumination device 130 will not be bent, so as to prevent solder joints on the first soldering section 116 or the second soldering section 126 from cracking due to bending stress. Moreover, the transparent glue layer 150 also serves as a light guide device, so as to significantly increase the beam angle of the light source 132.

Figure 5:
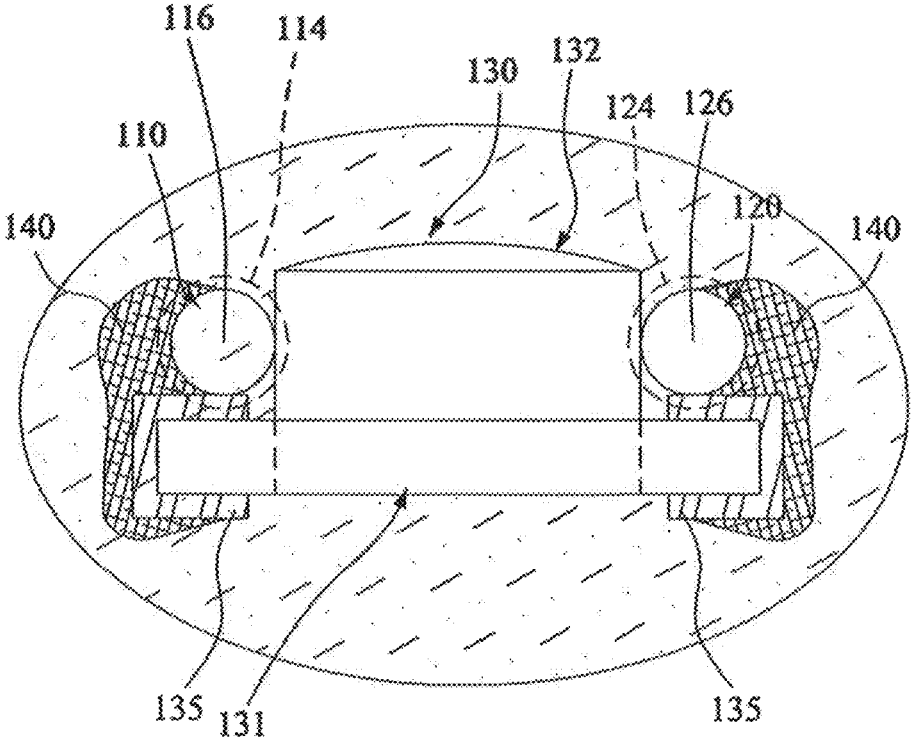
FIG. 5 is a cross-sectional view of the light string according to the first embodiment of the present disclosure.

Referring to FIG. 5, when the first wire 110 and the second wire 120 are pulled, the first soldering section 116 and the second soldering section 126 press against the illumination device 130 with only minimal shear stress between the soldering portions 134 and the first soldering section 116 or between the soldering portions 134 and the second soldering section 126. Therefore, the light string 100 also prevents solder joints on the first soldering section 116 or the second soldering section 126 from cracking due to shear stress.

That is, the coverage of the transparent glue layer 150 strengthens the light string 100 to withstand bending stress, and the arrangement of the first soldering section 116, the second soldering section 126 and the illumination device 130 strengthens the light string 100 to withstand shear stress.

In an embodiment, the first conductor 112 and/or the second conductor 122 may be solid, single-strand conductors (single piece copper conductor or metal conductor made of an appropriate conductive metal, such as copper, a copper alloy, and so on) as is depicted in FIG. 1 to FIG. 5. Alternatively, the first conductor 112 and/or the second conducting wire 122 may comprise stranded conductors instead of a single piece conductor. In the first embodiment, the first second insulating layer 114 and the second insulating layer 124 are respectively plastic insulators, such as polyvinylchloride (PVC). In one or more embodiments, the first insulating layer 114 and the second insulating layer 124 are very thin layers of insulation, such as an enamel coating, such that the first wire 110 or the second wire 120 are enameled wires. In one or more embodiments, the first insulating layer 114 and the second insulating layer 124 are combined into one piece for convenience of wire arrangement.

Figure 6:
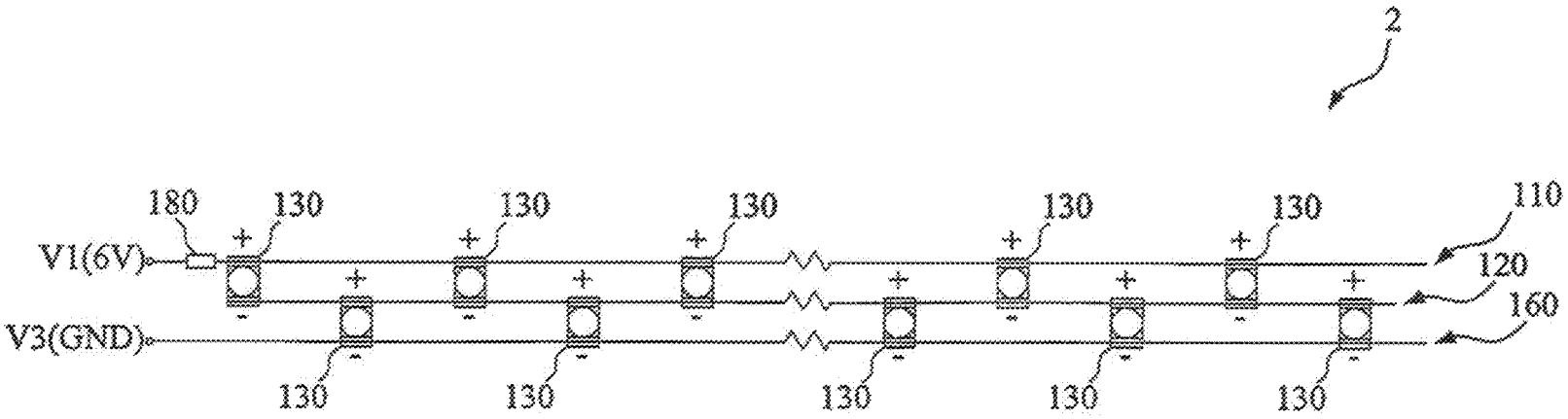
FIG. 6 is a circuit diagram of a circuit of light string according to a second embodiment of the present disclosure.
Figures 6A, 6B:
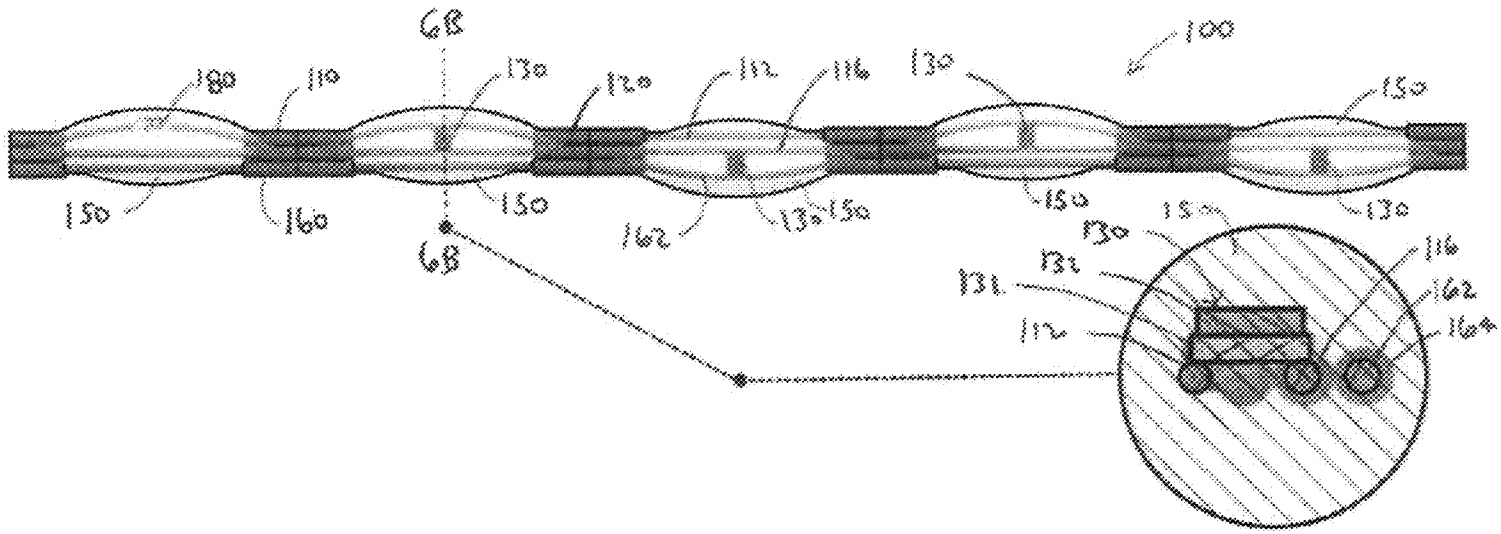
FIG. 6A is a depiction of a light string having the circuit of FIG. 6, according to an embodiment of the present disclosure.
FIG. 6B is a simplified cross-sectional view of the light string of FIG. 6A.

Referring to FIGS. 6, 6A and 6B, features of a 3-wire light string 100 and circuit 2 are depicted. FIG. 6 depicts an electrical schematic of a circuit 2; FIG. 6A depicts an embodiment of a 3-wire light string 100; and FIG. 6B depicts a simplified cross-sectional view of light string 100. Although FIG. 6B depicts an embodiment of illumination device 130 positioned on top of conductors 112, 116 and 162 for the sake of illustrating the basic electrical connections of illumination device 130 with wires 110, 120 and 160, it will be understood that other embodiments of light string 100 are consistent with the previous description and depictions of illumination device 130 being attached "below" or between the respective conductors.

Referring to FIG. 6, a circuit 2 of the light string 100 is depicted according to a second embodiment of the present disclosure. In the embodiment of FIG. 6, multiple illumination devices 130 are arranged in series and parallel on three wires to form light string 100.

As depicted in FIGS. 6, 6A and 6B, the circuit 2 in the second embodiment includes a first wire 110, a second wire 120, a third wire 160 and a plurality of illumination devices 130. Third wire 160 includes conductor 162 and insulation layer 164.

The first wire 110 is used to receive a first electric potential V1; and in one example, the first electric potential is 6V direct current (DC). The third wire 160 is used to receive a third electric potential V3; and in one example the third electric potential V3 is ground potential (GND). The second wire 120 is used as a connection node among the illumination devices 130.

In an embodiment, each of the illumination devices 130 is substantially identical to the illumination device 130 in the first embodiment. In the second embodiment, the soldering portions 134 of each illumination device 130 are sorted into an anode soldering portion (+) and a cathode soldering portion (−) according to the polarity of the light source 132 (in particular to the LED polarity). The carrier portion 133 as described in the first embodiment is located between the anode soldering portion (+) and the cathode soldering portion (−) and the light source 132 is disposed on the carrier portion 133 and electrically connected to the anode soldering portion (+) and the cathode soldering portion (−).

As depicted in FIG. 6, some of the illumination devices 130 are electrically connected to the first wire 110 at the anode soldering portions (+) and electrically connected to the second wire 120 at the cathode soldering portions (−). The other illumination devices 130 are electrically connected to the second wire 120 at the anode soldering portions (+) and electrically connected to the third wire 160 at the cathode soldering portions (−).

Therefore, the illumination devices 130 are sorted into two groups. In the first group, the illumination devices 130 are electrically connected in parallel by connection to the first wire 110 and the second wire 120 respectively. In the second group, the illumination devices 130 are electrically connected in parallel by connected to the second wire 120 and the third wire 130 respectively.

The first group is electrically connected to the second group in series via the second wire 120.

As shown in FIG. 6, in an embodiment, the circuit 2 further includes a current-limiting resistor 180, electrically connecting the first electric potential V1 to the first wire 110 for limiting current in the first wire 110. The current-limiting resistor 180 limits the current in the first wire 110, so as to prevent the illumination devices 130 from being damaged by over-current. In an embodiment, a section of a conductor of the wire is cut out, or the conductor is otherwise cut or interrupted, and a resistor may be soldered between the two resulting ends of the conductor.

In the second embodiment, the first wire 110, the second wire 120 and the third wire 130 are arranged in parallel. In one such embodiment, the insulating layers of the first wire 110, the second wire 120 and the third wire 160 can be combined together into a unitary layer and only the sections of the wires on which the illumination devices 130 are disposed need have insulation removed. Therefore, the circuit 2 becomes a long single-piece light string.

Figure 7:
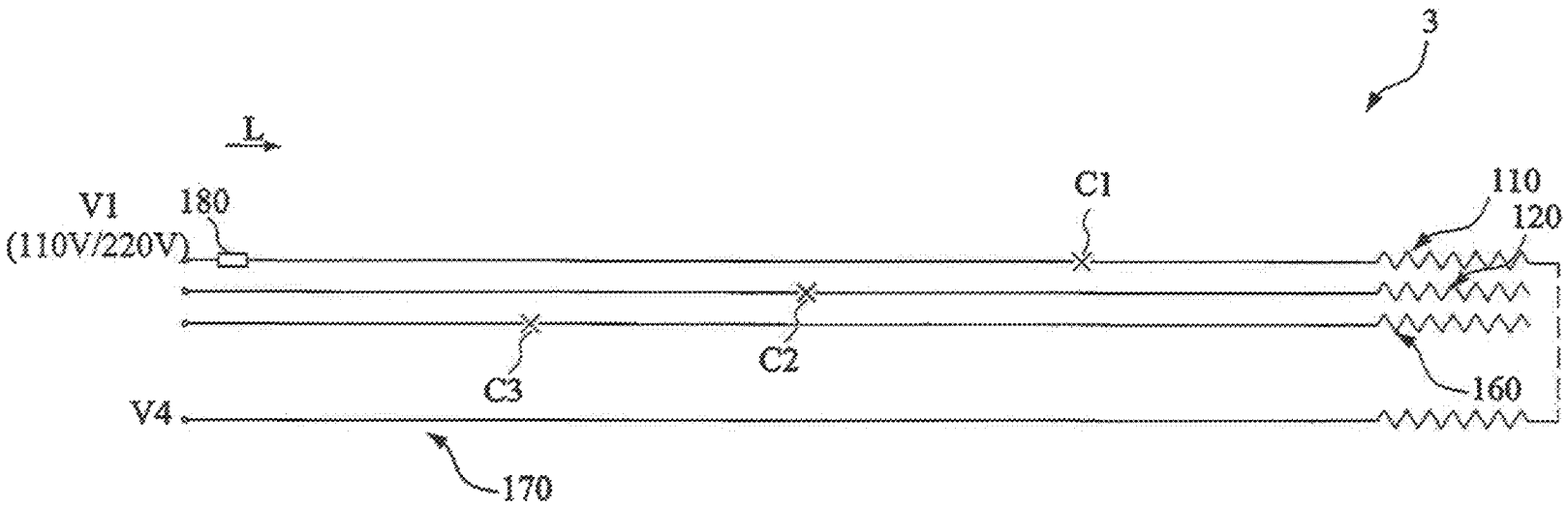
FIG. 7 and FIG. 8 are circuit diagrams of a circuit of light string according to a third embodiment of the present disclosure.
Figure 8:
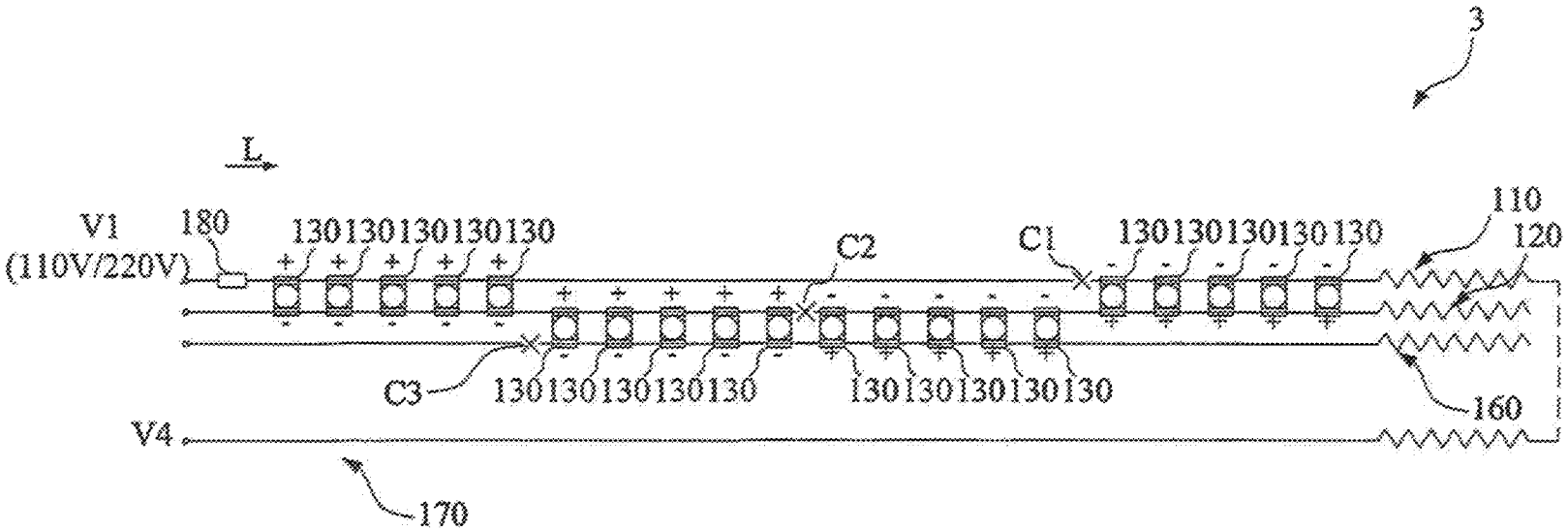

Referring to FIG. 7 and FIG. 8, a circuit 3 of the light string according to a third embodiment includes a first wire 110, a second wire 120, a third wire 160 and a plurality of illumination devices 130. The circuit 3 further includes a third cut-off point C3, a second cut-off point C2 and a first cut-point C1 to form the circuit loop in the third embodiment. Cut-off points are points along a length of the wire wherein the conductor is "broken" or interrupted, such that the conductor of the wire is not contiguous. In an embodiment, a portion of the conductor is removed to achieve a discontinuity; in other embodiments, the conductor is simply cut. In the latter embodiment, lengthwise tension on the conductor may cause a gap between ends of the conductor, or alternatively, portions of the conductor may be bent away from one another to form a gap.

As shown in FIG. 7, the first wire 110, the second wire 120 and the third wire 130 are arranged in parallel to an extension direction L; in one embodiment, the three wires are single metal wires or stranded conductors combined together by a one-piece insulating layer. The one-piece insulating layer may comprise a uniform or non-uniform layer thickness. In an embodiment, a portion of a thin connecting layer joins any two conductors together.

The third cut-off point C3, the second cut-off point C2 and the first cut-point C1 are arranged sequentially along the extension direction L, respectively breaking conductive continuity of the third wire 160, the second wire 120 and the first wire 110 so as to divide the circuit 3 into a plurality of sections based on the third cut-off point C3, the second cut-off point C2 and the first cut-off point C1.

In an embodiment of FIG. 7, each of the illumination devices 130 is substantially identical to the illumination device 130 in the first embodiment or the second embodiment. Each of the illumination devices 130 includes a substrate 131 and a light source 132. The substrate 131 includes a carrier portion 133, an anode soldering portion (+) and a cathode soldering portion (−). The carrier portion 133 is located between the anode soldering portion (+) and the cathode soldering portion (−). The light source 132 is disposed on the carrier portion 133, and electrically connected to the anode soldering portion (+) and the cathode soldering portion (−).

Referring to FIG. 8, the illumination devices 130 are sorted into groups. The first group of the illumination devices 130 are arranged before the first cut-off point C1 along the extension direction L (starting from the left side of FIG. 8), electrically connected to the first wire 110 by the anode soldering portions (+), and electrically connected to the second wire 120 by the cathode soldering portions (−).

Referring to FIG. 8, the second group of the illumination devices 130 are arranged between the third cut-off point C3 and the second cut-off point C2 along the extension direction L, electrically connected to the second wire 120 by the anode soldering portions (+), and electrically connected to the third wire 160 by the cathode soldering portions (−).

Still referring to FIG. 8, the third group of the illumination devices 130 are arranged after the second cut-off point C2 along the extension direction L, electrically connected to the second wire 120 by the cathode soldering portions (−), and electrically connected to the third wire 160 by the anode soldering portions (+).

The fourth group or the rest of the illumination devices 130 are arranged after the first cut-off point C1 and the second cut-off point C2 along the extension direction L electrically connected to the first wire 110 by the cathode soldering portions (−), and are electrically connected to the second wire 120 by the anode soldering portions (+).

With such an approach, the illumination devices 130 are sorted into four groups. In the first group, the illumination devices 130 are electrically connected in parallel by connection to the first wire 110 and the second wire 120 respectively. In the second group, the illumination devices 130 are electrically connected in parallel by connection to the second wire 120 and the third wire 130 respectively.

Meanwhile, the first group is electrically connected to the second group in serial via the second wire 120.

In the third group, the illumination devices 130 are electrically connected in parallel by connection to the second wire 120 and the third wire 130 respectively.

The polarity of the third group is opposite to the second group, and the second wire 120 between the second group and the third group is cut off by the second cut-off point C2. Therefore, the third group of illumination devices 130 is serially connected to the second group of illumination devices 130. Similarly, in the fourth group, the illumination devices 130 are electrically connected in parallel by connection to the first wire 110 and the second wire 120 respectively. The polarity of the fourth group is opposite to the first group, and the first wire 120 between the first group and the fourth group is cut off by the first cut-off point C1. Therefore, the fourth group of illumination devices 130 is serially connected to the third group of illumination devices 130.

Still referring to FIG. 8, one end of the first wire 110 receives a first electric potential V1; and in one example, the first electric potential is an alternating current (AC) voltage, such as 110V or 220V. In an embodiment, the other end of the first wire 110 is electrically connected to a boost line 170. A boost potential V4 is provided by the boost line 170 according to the electric potential of the first wire 110 and required drive voltage for driving the four groups of illumination devices 130, so as to boost the voltage applied to each illumination device 130. Generally, the longer the wire, the greater the power consumed by the LEDs, and the greater the potential to have an overall voltage drop delivered to the LEDs furthest from the connection point of the power source. Such a situation can cause some illumination devices 130 to receive a lower voltage than other devices 130, causing a disparity in light output. A solution according to an embodiment is to connect a boost line 170 as described herein.

Similarly, in the third embodiment, the first wire 110, the second wire 120, the third wire 130 and the boost line 170 are arranged in parallel, the circuit 3 becomes a long single piece light string for convenience of wires arrangement.

Still referring to FIG. 8, in an embodiment, the circuit 3 further includes a current-limiting resistor 180, electrically connecting the first electric potential V1 to the first wire 110 for limiting current in the first wire 110. The current-limiting resistor 180 limits the current in the first wire 110, so as to prevent the illumination devices 130 from being damaged by over-current. Alternatively, the current-limiting resistor 180 is disposed on the boost line 170, which is also located on the serial current loop to limit the current thereon.

Figure 9:
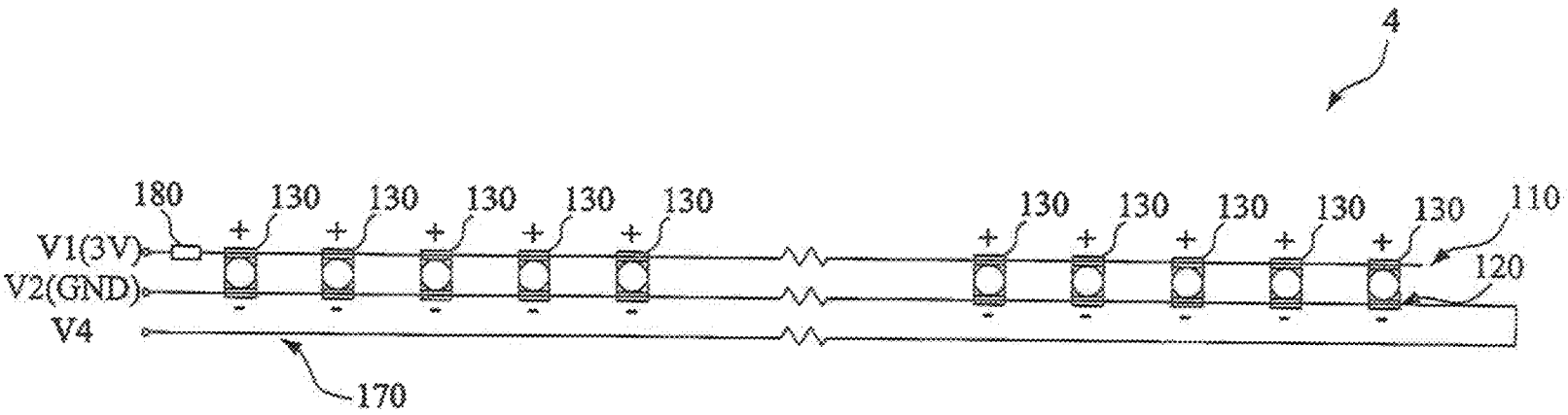
FIG. 9 is a circuit diagram of a circuit of light string according to a fourth embodiment of the present disclosure.
Figure 9A:
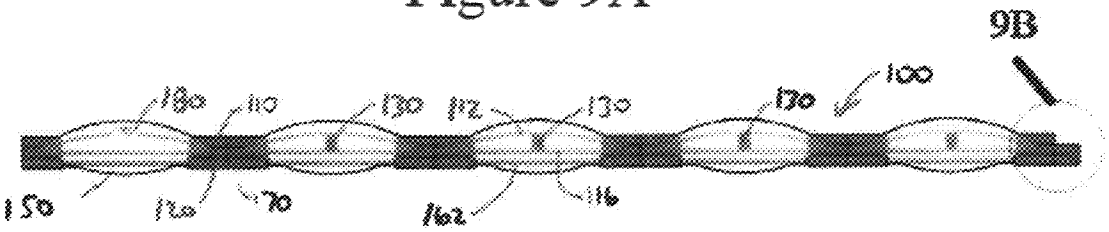
FIG. 9A is a depiction of a light string having the circuit of FIG. 9, according to an embodiment of the present disclosure.
Figure 9B:
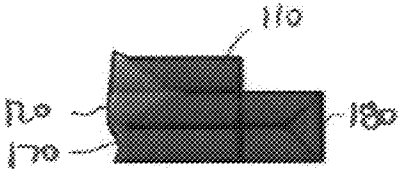
FIG. 9B is a view of a portion of the light string of FIG. 9A, according to an embodiment of the present disclosure.

Referring to FIGS. 9, 9A and 9B, a circuit 4 of the light string is shown according to a fourth embodiment of the present disclosure.

The circuit 4 includes a first wire 110, a second wire 120, a boost line 170 and a plurality of illumination devices 130.

The first wire 110 is used to receive a first electric potential V1; and in an embodiment, the first electric potential is 3V direct current (DC). The second wire provides a second electric potential V2 and in one example the second electric potential V2 is ground potential (GND). And the boost line 170 receives a boost potential V4.

Similar to the first embodiment, each of the illumination devices 130 includes a substrate 131 and a light source 132. The substrate 131 includes a carrier portion 133, an anode soldering portion (+) and a cathode soldering portion (−).

The carrier portion 133 is located between the anode soldering portion (+) and the cathode soldering portion (−). The light source 132 is disposed on the carrier portion 133. The detailed description of each illumination device 130 is described in the first embodiment. In the fourth embodiment, each of the illumination devices 130 are electrically connected to the first wire 110 by the anode soldering portions (+) and electrically connected to the second wire 120 by the cathode soldering portions (−). The boost line 170 is electrically connected to the second wire 120.

By such an approach, the illumination devices 130 are electrically connected in parallel between the first wire 110 and the second wire 120, and the illumination devices 130 are normally driven by the voltage difference between the first wire 110 and the second wire 120. A boost potential V4 is provided by the boost line 170 according to the electric potential of the first wire 110 and required drive voltage for driving the illumination devices 130, so as to boost the voltage applied to each illumination device 130.

Similarly, in the fourth embodiment, the first wire 110, the second wire 120 and the boost line 170 are arranged in parallel, the circuit 3 becomes a long single-piece light string based on the convenient joined-wire arrangement.

In an embodiment, boost line 170 is electrically connected to wire 120. In one such embodiment, and also referring to FIG. 9B, boost line 170 comprises a portion of wire 120 that is bent at bend 180, such that wire 120 extends away from a power source, then back towards the power source. In another embodiment, boost line 170 comprises a separate and distinct wire that is electrically connected to wire 120.

In an embodiment, the circuit 4 further includes a current-limiting resistor 180, electrically connecting the first electric potential V1 to the first wire 110 for limiting current in the first wire 110. The current-limiting resistor 180 limits the current in the first wire 110, so as to prevent the illumination devices 130 from being damaged by over-current. Alternatively, the current-limiting resistor 180 is disposed on the boost line 170, which is also located on the serial current loop to limit the current thereon.

Figure 10:
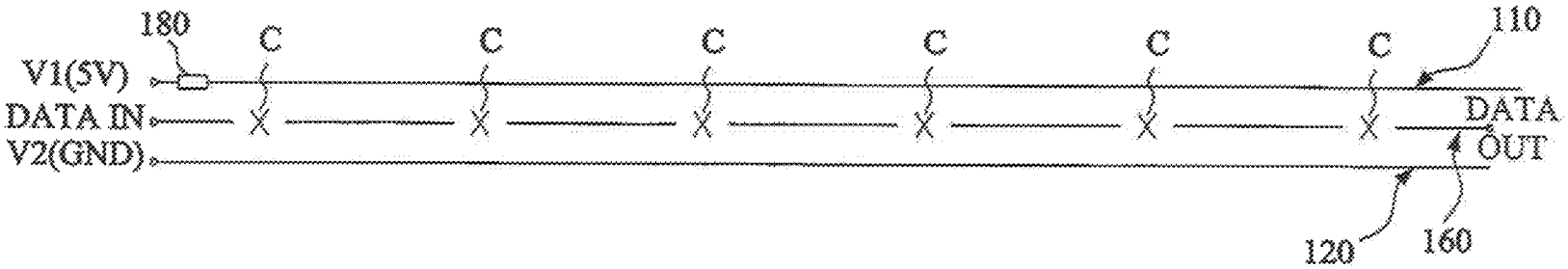
FIG. 10 and FIG. 11 are circuit diagrams of a circuit of a light string according to a fifth embodiment of the present disclosure.
Figure 11:
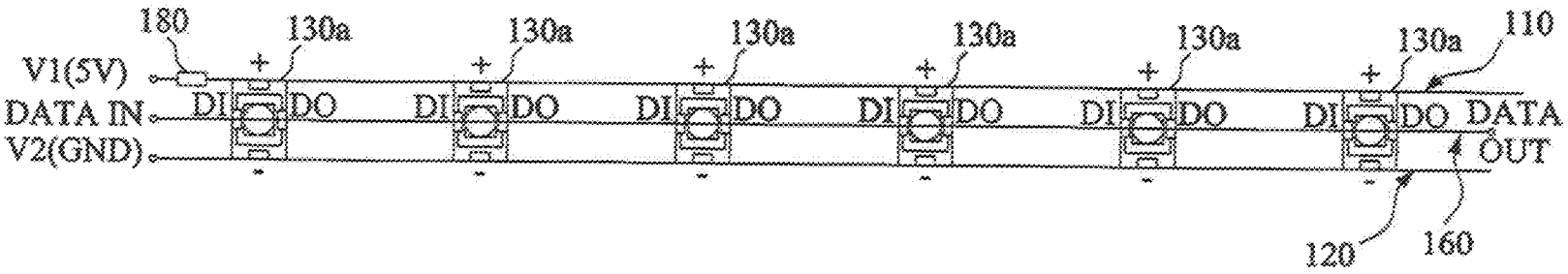

Referring to FIG. 10 and FIG. 11, a circuit 5 of the light string is shown according to a fifth embodiment of the present disclosure.

The circuit 5 includes a first wire 110, a second wire 120, a plurality of illumination devices 130, and a third wire 160.

Figure 12:
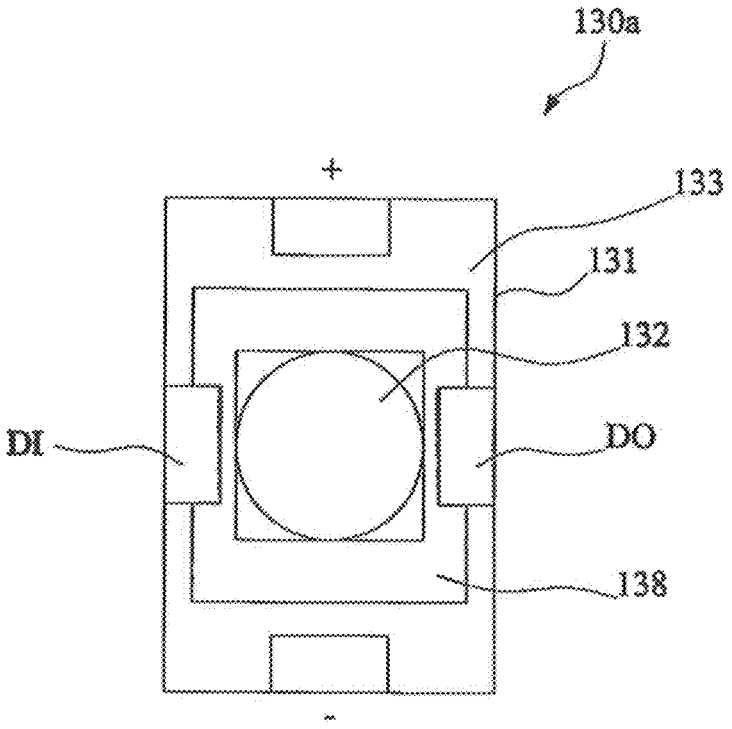
FIG. 12 is a top view of an illumination device according to the fifth embodiment of the present disclosure.

Referring also to FIG. 12, each of the illumination devices 130 may be substantially identical to the illumination device 130 in the first embodiment or the other embodiment. Each of the illumination devices 130 includes a substrate 131 and a light source 132. The substrate 131 includes a carrier portion 133, an anode soldering portion (+) and a cathode soldering portion (−). The carrier portion 133 is located between the anode soldering portion (+) and the cathode soldering portion (−). The light source 132 is disposed on the carrier portion 133, each of the illumination devices 130*a* are electrically connected to the first wire 110 by the anode soldering portions (+) and electrically connected to the second wire 120 by the cathode soldering portions (−). The detail of the illumination devices 130 is described in the first embodiment.

The difference of the illumination devices 130*a* in the fifth embodiment is that the illumination devices 130*a* may further include a controller 138; the controller 138 is combined with the substrate 131 for enabling and disabling the light source 132. The controller 138 includes a signal input terminal DI and a signal output terminal DO;

Referring to FIG. 10 and FIG. 11, the first wire 110 is used to receive a first electric potential V1; and in one example, the first electric potential is 5V DC. The second wire provides a second electric potential V2, and in one example the second electric potential V2 is GND. The third wire 160 includes a signal input end DATA IN and a signal output end DATA OUT, and a plurality of cut-off points C being arranged on the third wire 160. Each of the illumination devices 130 is disposed at one of the cut-off points C respectively, and the signal input terminal DI and the signal output terminal DO are electrically connected to the third wire 160 respectively via different sides of the corresponding cut-off point C. The signal input terminal DI corresponds to the signal input end DATA IN of the third wire 160. The signal output terminal DO corresponds to the signal output end DATA OUT of the third wire 160.

The third wire 160 receives control signals for enabling and disabling the light source 132 via the signal input end DATA IN. The third wire 160 transfers the control signals to the controller 138 via the signal input terminal DI for controlling the corresponding light source 138, and then the control signal is transferred to the controller 138 of the next illumination device 130*a* via the signal output terminal DO. Finally, the control signals are transferred to the circuit 5 of another light string.

In an embodiment, light string 100 may also include, or be connected to, an primary controller that transmits data to controllers 138. Such data may include commands to selectively control the light sources 138, may include addresses of individual controllers 138, may include commands to utilize instructions stored in a memory device, which may be part of a controller 138 or illumination device 130. In one such embodiment, the primary controller transmits data to wire 160 and an input end DATA IN of a first controller 138 of light string 100, which is then transmitted to other controllers 138 as described above. In another embodiment, a primary controller transmits data via wires 110 and 120, such as via a modulated power signal.

As shown in FIG. 11, in an embodiment, the circuit 5 further includes a current-limiting resistor 180, electrically connecting the first electric potential V1 to the first wire 110 for limiting current in the first wire 110. The current-limiting resistor 180 limits the current in the first wire 110, so as to prevent the illumination devices 130 from being damaged by over-current.

In the present disclosure, the illumination devices 130 are securely soldered between the first wire 110 and the second wire 120, and provide a good illumination effect. Moreover, the circuit of light string in the present disclosure provides a variety of approaches of power supply to adopt various type of light source, and ensures every light source can receive acceptable power input to prevent under voltage resulting from too many light sources.

Referring to FIGS. 13-17, embodiments of dual-color, or color-changing light strings, circuits and illumination assemblies are depicted.

Figure 13:
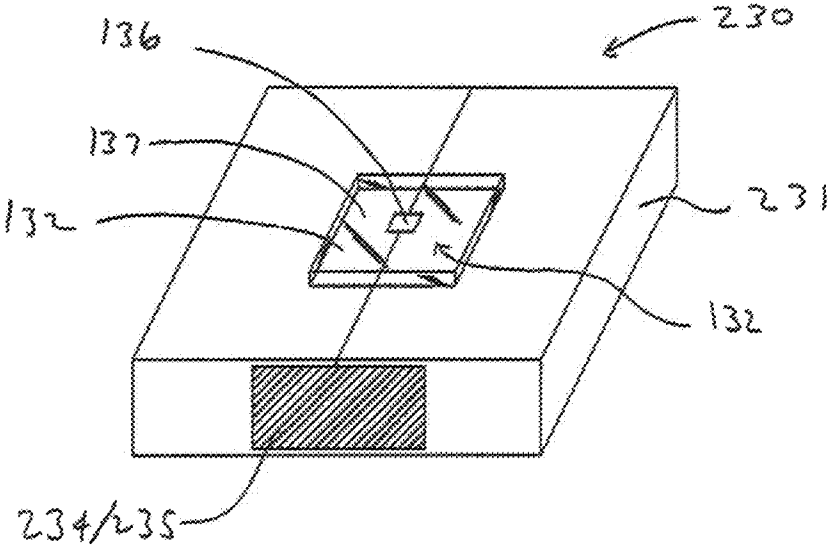
FIG. 13 is a perspective view of an illumination device according to a sixth embodiment of the present disclosure.

Referring specifically to FIG. 13, an illumination device 230 is depicted. Illumination device 230 is substantially the same as illumination device 130, with the exception of the substrate and soldering portions. In the embodiment of illumination device 230, rather than having soldering portions 135 that wrap around substrate 131 such that the soldering portions are on both the sides and top of the substrate, illumination device 230 includes a pair of soldering portions 234 that, in an embodiment, are located only on the sides of substrate 231. In other embodiments, portions of soldering portions 234 may extend around the edges of substrate 231 to either a bottom portion, top portion, or both, of substrate 231. Substrate 231, in an embodiment, is substantially the same as substrate 131, with the exception of the structure corresponding to, or interacting with, soldering portions 234.

As described further below, pairs of illumination devices 230, each of the pair emitting a different color light, may be used to form color-changing illumination assemblies and a light string. In other embodiments, and as also described further below, illumination devices 130 may also be used to form color-changing illumination assemblies and light strings.

Figure 14:
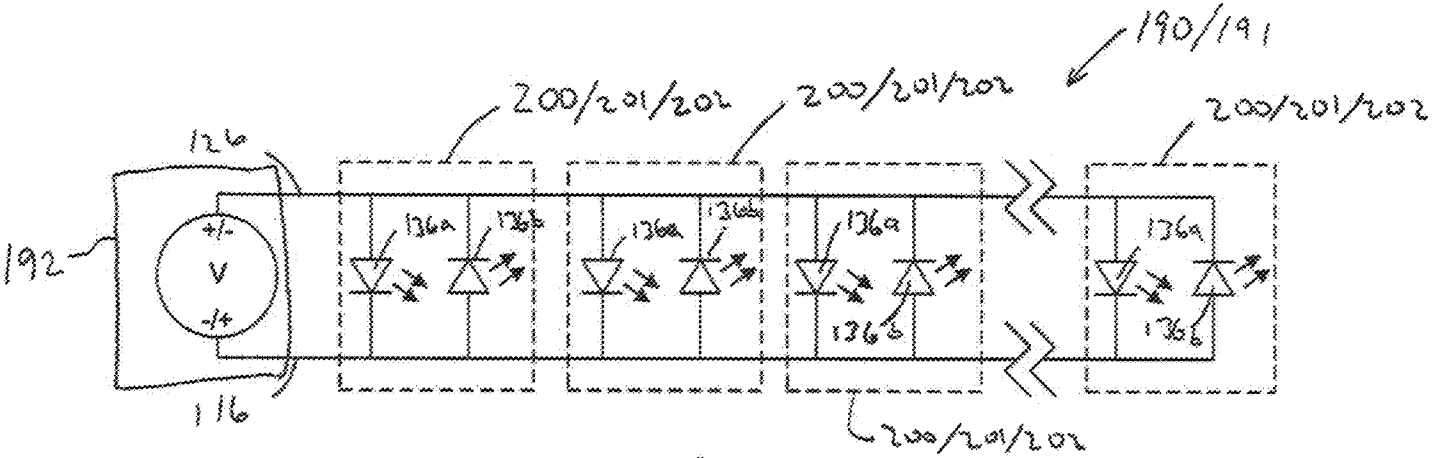
FIG. 14 is a schematic illustration of a circuit of a dual-color, color-changing light string according to an embodiment.

Referring to FIG. 14, an embodiment of circuit 190 of a dual-color, color-changing light string 191 is depicted. In the depicted embodiment, circuit 190 includes controller 192 controlling voltage V, and a plurality of dual-color illumination assemblies 200. As described below, in alternate embodiments, dual-color illumination assemblies 201 or 202 may be used instead of assemblies 200, the difference primarily being in the orientation of the light components and direction of light.

Each dual-color illumination assembly 200 (or 201 or 202) includes a first light-emitting component 136*a*, also known as a light source, which in an embodiment comprises a first LED, and a second light-emitting component 136*b*, which in an embodiment comprises a second LED. First and second LEDs 136*a* and 136*b* are electrically connected to one another in parallel. However, LEDs 136*a* and 136*b* are electrically configured with opposite polarities with respect to the provided voltage V. In other words, the anodes of LEDs 136*a* are connected to the cathodes of LEDs 136*b*, and the cathodes of LEDs 136*a* are connected to the anodes of LEDs 136*b*, as depicted. As such, either LEDs 136*a* are powered on, or LEDs 136*b* are powered on, when voltage V is applied.

In an embodiment, LEDs 136*a* will emit light of a first color, and LEDs 136*b* will emit light of a second color, the first color being different from the second color. For example, first LEDs 136*a* may emit white light, while LEDs 136*b* may emit blue light. In other embodiments, each "LED 136*a*" or "LED 136*b*" may actually comprise a plurality of LEDs that operate together to emit light of a desired wavelength and color. For example, either or both of LEDs 136*a* or 136*b* may comprise three LEDs each, one red, one blue, one green, known as an RGB LED, that can be controlled by a control chip in communication with the three LEDs to emit light of a predetermined wavelength. Such a control chip may be located within assembly 200 (or 201 or 202).

In an embodiment, controller 192 may include one or more processors, memory devices storing light-display or color-changing software programs and instructions, power conditioning circuitry, selector switches, a power plug, and other such electronic hardware and software as would be understood by one of ordinary skill in the art. In an embodiment, controller 192 may also include, or be in communication with, a power transformer that converts AC power to DC power. Controller 192 may also be connected to a power plug of the light string that is configured to receive power from an external source, which may be an AC power.

In operation, controller 192 controls voltage V, alternating voltage polarity between a positive and a negative (or ground) voltage, with respect to LEDs 136*a* and 136*b*. In other words, controller 192 controls voltage V so that in a first mode, a positive voltage potential is applied across LEDs 136*a* and 136*b* from the anodes of LEDs 136*a* and cathodes of LEDs 136*b* to the cathodes of 136*a* and anodes of LEDs 136*b*. In this first mode or state, LEDs 136*a* will emit light due to the applied voltage, while LEDs 136*b* will not. In a second mode or state, controller 192 switches the polarity of voltage V, applying a positive voltage potential across LEDs 136*b*, such that LEDs 136*b* will emit light, while LEDs 136*a* will not.

Controller 192 can switch or "change" the voltage polarity, thereby changing the color or wavelength of light emitted from assemblies 200/201/202 and the dual color, color-changing light string 191. Controller 192 may be configured or programmed to maintain a constant first color or second color, either automatically, or to automatically switch back and forth at various rates and for various durations, according to programmed and/or selected instructions.

Figure 15:
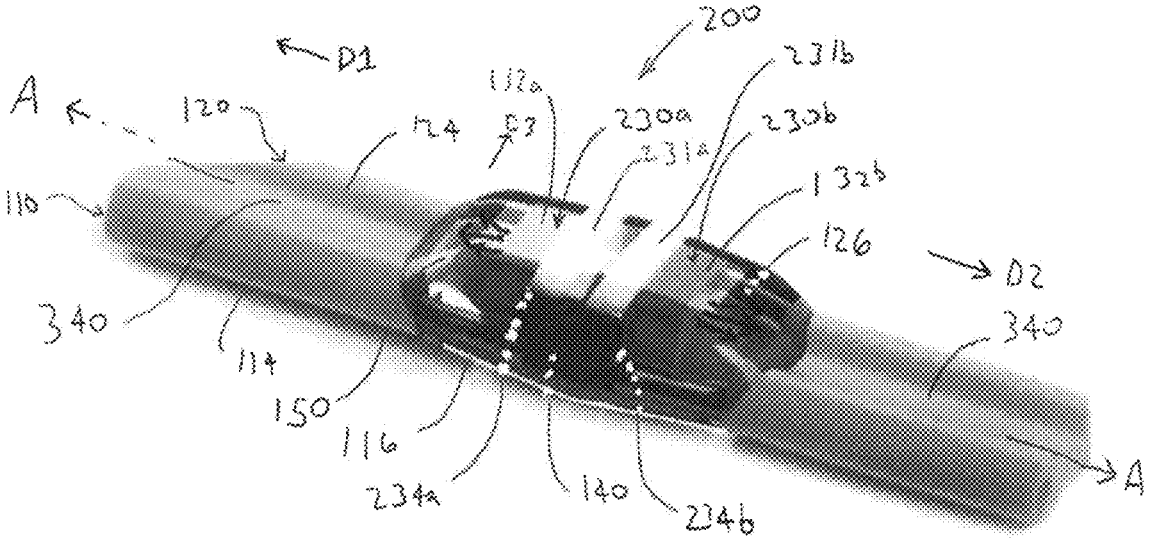
FIG. 15 is a perspective view of a portion of a dual-color, color-changing light string, including a dual-color illumination assembly having illumination devices directed axially and in opposite directions, according to an embodiment.
Figure 16:
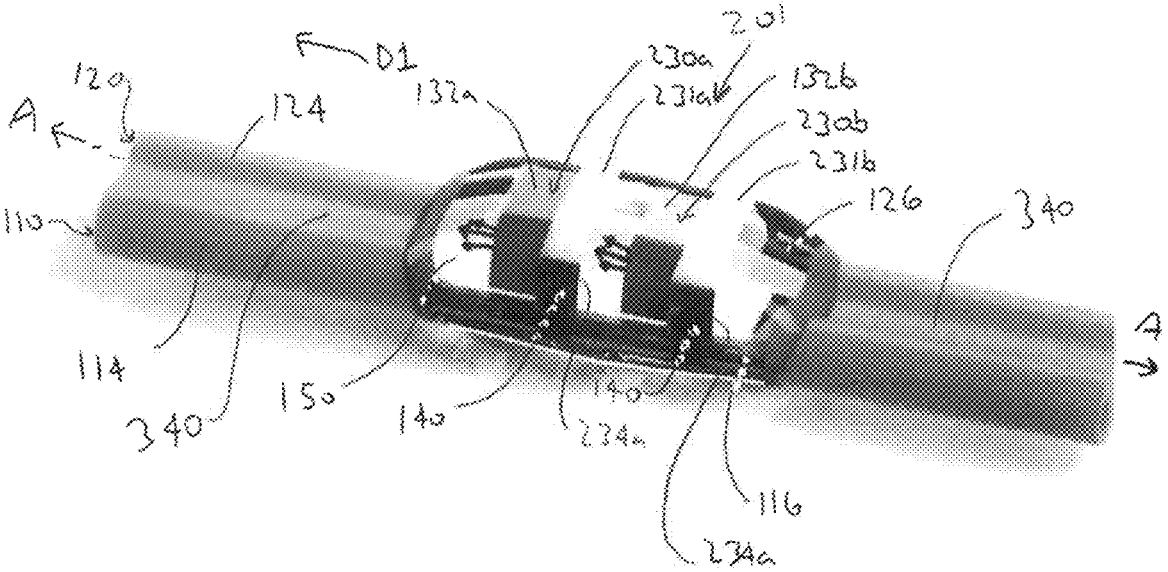
FIG. 16 is a perspective view of a portion of a dual-color, color-changing light string, including a dual-color illumination assembly having illumination devices directed axially and in the same direction, according to an embodiment.
Figure 17:
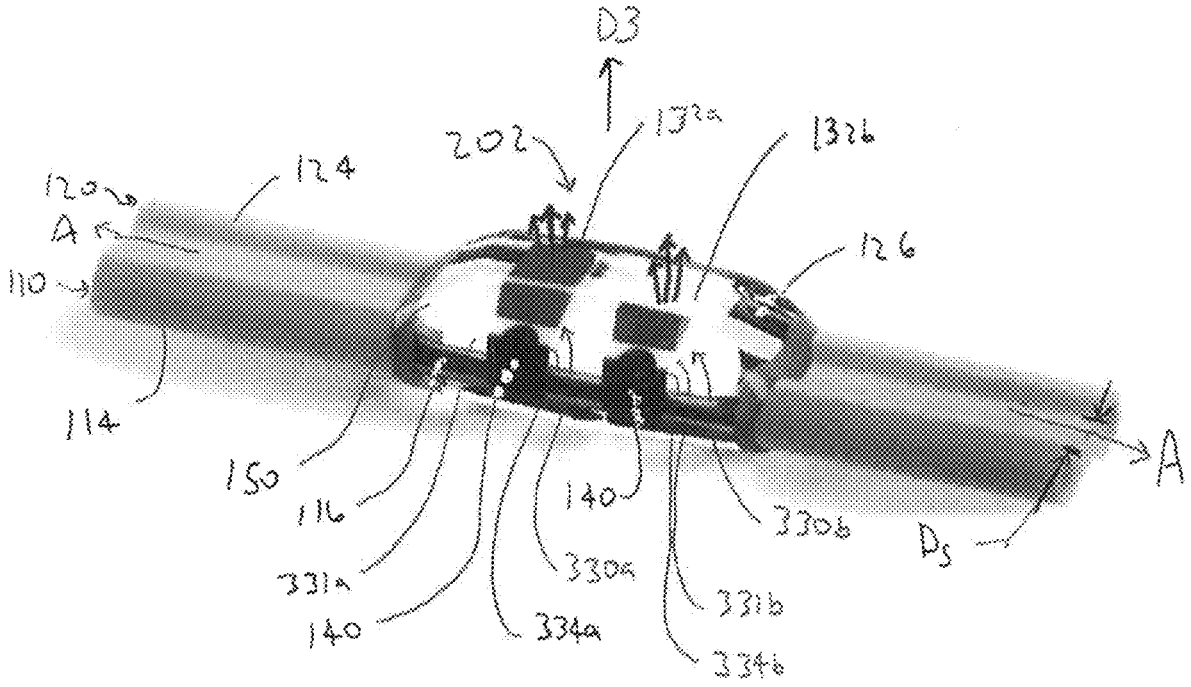
FIG. 17 is a perspective view of a portion of a dual-color, color-changing light string, including a dual-color illumination assembly having illumination devices directed transversely to a lengthwise axis of the wires of the light string.

Referring to FIGS. 15-17, embodiments of portions of dual-color, color-changing light strings that include illumination assemblies and illumination devices attached to light string wiring are depicted. Generally, and as described further below, FIG. 15 depicts an embodiment of a dual-color illumination assembly 200 wherein the illumination devices 230 (230*a* and 230*b*) with their respective light emitting components or light sources 136 (136*a* and 136*b*) are positioned to emit light toward the wires 110 and 120 in a direction generally parallel to a lengthwise axis of the wires, first light emitting component 136*a* positioned to emit light in a first axial direction, and the second light emitting component 136*b* positioned to emit light in a second, opposite axial direction; FIG. 16 depicts an embodiment of a dual-color illumination assembly 201, wherein illumination devices 230 (230*a* and 230*b*) with their respective first light-emitting component 136*a* and the second light-emitting component 136*b* are positioned to emit light axially in a common (same) direction; and FIG. 17 depicts an embodiment of a dual-color light-emitting component 202, wherein the illumination devices 230 (230*a* and 230*b*) with their respective first light-emitting component 136*a* and second light emitting component 136*b* are positioned to emit light in a direction transverse to the wire axis.

It will be understood that dual-color illumination assemblies 200, 201 and 202 are similar to previously-described single-color illumination assemblies described above with respect to FIGS. 1-5, though as is apparent from the drawings, are different with respect to the number of light-emitting components per assembly (generally, two instead of one), orientation of the light-emitting components and connecting structure allowing same. Further, it will be understood that dual-color illumination assemblies 200, 201 and 202 may be incorporated into color-changing light strings using the described circuits, electrical connections, and manufacturing methods described above with respect to FIGS. 6-12.

Referring specifically to FIG. 15, dual-color illumination assembly 200 is depicted. In the depicted embodiment, dual-color illumination assembly 200 includes a pair of illumination devices 230, namely, a first illumination device 230*a* and a second illumination device 230*b*. In other embodiments, additional illumination devices 230 may be present, such that illumination assembly 200 includes three, four, or more illumination devices.

First illumination device 230*a* is connected to soldering section 116 of wire 110 at soldering portion 234*a* at a first side as depicted, and to soldering section 116 of wire 120 at another soldering portion 234*a* at a second, opposite, side, via solder 140. In an embodiment wherein illumination device 230*a* includes a light-emitting component 136*a* that comprises an LED (see also FIG. 13), a cathode of the LED that is component 136*a* is electrically connected to a soldering portion 235, which is in turn electrically connected to a soldering section 116 of either wire 110 or wire 120. An anode of the LED that is component 136*a* is electrically connected to a soldering section 116 of either wire 120 or 110 (if the cathode is connected to wire 110, then then the anode is connected to wire 120; if the anode is connected to wire 110, then then the cathode is connected to wire 120. As such, the light-emitting component 136*a*, an LED, is electrically connected to wire 110 and 120 so as to receive power from the wires 110 and 120. As described above with respect to FIG. 13, when power is applied to cause a positive voltage potential to be applied to the LED from anode to cathode, then the LED will emit light.

In the embodiment depicted in FIG. 15, first illumination device 230*a* is oriented such that outer or top surfaces of transparent package body (lens) 137 and substrate 231*a* face portions of insulated wires 110 and 120, and such that light emitted from the illumination device 230*a* is directed generally in a direction D1. D1 is a direction that is generally parallel to lengthwise, wire axis A. It will be understood that "directed generally in a direction D1" means that light is emitted toward the wires along the axis A, but that due to the nature of light emissions as emitted from the LED and through the lens 137, not all light will be emitted in directions that are strictly parallel to Axis A. In other words, a direction of the light emissions will include a non-zero value in the D1 direction.

Further, defining axis A as a "horizontal" axis, in an embodiment, illumination device 230*a* may be positioned vertically such that soldering sections 116 of wires 110 and 120 contact lateral sides of substrates 231 and their respective conductive soldering portions 234 so as to bisect the lateral side of the substrate 231. In other words, illumination device 230*a* may be positioned such that about half of the device 230*a* is above the wire, and half is below. When this is the case, and when the light-emitting component 136*a* is approximately centered on substrate 231*a*, then light-emitting component 136*a* is aligned along axis A, and will direct light axially in direction D1, such that the light will reflect off of wires 110 and 120, including off of exposed portions of the wires, and insulated portions of the wires, including the area of insulation connecting wires 110 and 120.

During manufacture, after the step of exposing or removing insulation from soldering sections 116 of wires 110 and 120, illumination devices 230 may be inserted between two sections 116, causing sections 116 to flex opposite a wire axis direction, thereby exerting opposing forces on illumination devices 230, holding illumination devices 230 securely in position prior to the step of soldering. This provides a manufacturing advantage, allowing the next stop of soldering to proceed without the need to otherwise secure illumination devices 230 in position relative to soldering sections 116.

The distributed or disbursed light emission caused by reflection at the wires, along with refraction through lens 137, causes light to be directed in many different directions, including transversely to axis A, in a direction D3 (or opposite to D3) thereby causing a desired lighting effect. This lighting effect may be desirable because the resulting reflection and refraction of light in many directions, both vertically and horizontally, may be more easily perceived by an observer from multiple directions or angles.

Such a configuration may be ideal for use on an artificial tree. When light strings are placed on a tree, the result is that the orientations of the various LEDs may be random. This results in some of the LEDs, which tend to emit light in a somewhat unidirectional manner, depending on the lens configuration, emitting light into the interior of the tree, which may be difficult for an observer to perceive. This can result in the tree appearing dim, or less bright. However, in the embodiment of FIG. 15, even if illumination devices 230 are oriented to face an interior portion of an artificial tree after placement on the tree, light emitted is disbursed, or reflected and refracted as described above, such that not all light will be directed in the direction faced by the illumination device 230, i.e., not all light will be directed to the interior portion of the tree.

Accordingly, embodiments of the present invention also include artificial trees with branches and light strings, including dual-color light strings, distributed about the branches.

Illumination device 230*b* is mounted to wires 110 and 120 in a manner similar to that described above with respect to illumination device 230*a*. However, in the embodiment depicted in FIG. 15, illumination device 230*b* is oriented in a direction opposite to that of illumination device 230*a*, namely, in a direction D2, which is also axial, but opposite to D1. Illumination device 230*a* will be connected to wires 110 and 120 in an opposite polarity, as described above with respect to FIG. 13 (anode of 136*a* connected to cathode of 136*b*; cathode of 136*a* connected to anode of 136*b*). As such, illumination device 230*b* emits light generally in direction D2, which also reflects off of portions of wires 110 and 120 to create the desired disbursed lighting effect.

In operation, either first illumination device 230*a* or second illumination device 230*b* may emit light at any given time, producing the disbursed lighting effect in a first color or in a second color.

Referring to FIG. 16, illumination assembly 201 is depicted. Illumination assembly 201 is substantially the same as illumination assembly 200, with the exception that both illumination devices 230*a* and 230*b* are positioned to face, and emit light, in the same axial direction D1. In this embodiment, the effect is that light from illumination device 230*a* is directed axially toward portions of wires 110 and 120, causing reflection off the wire portions as described above. However, light from illumination device 230*b* is directed to a back surface of substrate 231*a* of illumination device 230*a*. As such, the lighting effect resulting from reflection of light emitted from illumination device 230*b* is somewhat different than that of illumination device 230*a*. Depending on the size of substrate 231*a*, distance between illumination devices 230*a* and 230*b*, and substrate materials, the effect can be that light is directed primarily transverse to axis A, from illumination assembly 201, when illumination device 230*b* is illuminated since substrate 231 may block emission of light in direction D1.

In such an embodiment, not only can illumination assembly 201 emit light of two different colors, but it can create two different light emission patterns, or lighting effects due to two different reflection effects (wire reflection vs. substrate reflection). Having two different light emission patterns may be a desirable feature in some applications.

Referring to FIG. 17, an illumination assembly 202 is depicted. Illumination assembly 202 is similar to illumination assembly 200 and 201, with at least the exception that illumination devices 230 in illumination assemblies 202 are facing upward, so as to direct light radially in a direction D3, or transversely to wire axis A.

In this embodiment, the illumination devices may employ illumination devices 230, though rotated 90 degrees about an axis orthogonal to axis A, as compared to illumination devices 230 of assemblies 200 and 201. In other embodiments, illumination devices may comprise illumination devices 130, described above, or may comprise illumination devices 330 that are substantially the same as illumination devices 130 or 230, but with modified soldering portions 334, and hence modified substrates 331. Soldering portions 334, in an embodiment, may extend from the sides of substrates 331 onto a top surface of substrate 331, or to a bottom of substrate 331. Such an arrangement may provide additional contact area for soldering and connecting soldering portions 334 to soldering sections 116 of wires 110 and 120.

In operation, illumination devices 330*a* and 330*b* both emit light generally in direction D3, which is transverse to axis A. Such an effect may be more desirable when the dual-color, color-changing light string is placed on a structure that does not obstruct viewing of the light string and its illumination assemblies, such as on a frame of a lighted sculpture, e.g., lighted deer or snowman, or on a house exterior, or inside a house, such as on a bannister.

Still referring to FIG. 17, as described above, wires 110 and 120 of light string 100 include wire insulation that includes insulating layers 114 and 124, respectively. In an embodiment, and as depicted in FIG. 17 (and FIGS. 15-16), insulating layer 114 and 125 are mechanically joined to one another by a joining portion 340, which may also be referred to as a connecting portion or web portion. In an embodiment, joining portion 340 extends laterally between insulating layers 114 and 124, as well as axially along axis A. In an embodiment, joining portion 340 extends continuously in an axial direction between insulation layers 114 and 124, joining or connecting wires 110 and 120 (and layers 114 and 124). In an embodiment, joining portion 340 does not extend axially beyond insulation layers 114 and 124 so as to be in contact with first and second soldering sections 116 and 126. In other words, in an embodiment, layers 114 and 124, as well as joining portions 340, form a plurality of parallel segments of insulating layers extending horizontally, with soldering sections 116 and 126 therebetween.

In an embodiment, a thickness of joining portion 340 is substantially uniform both laterally and axially; in one such embodiment, the thickness of joining portion 340 is less than an outside diameter of insulated wires 110 and/or 120.

Joining portion 340 creates a separation or spacing, distance or gap, between wires 110 and 120 (and insulating layers 114 and 124), the separation being defined by a particular distance Ds. In an embodiment, distance Ds may be approximately the same as, or less than, a diameter of insulated wire 110 or insulated wire 120. In an embodiment, distance Ds that separates wires 110 and 120 may be greater than a diameter of insulated wires 110 and 120. In an embodiment, distance Ds may be greater than a diameter of conductors 112 and 122.

In an embodiment, distance Ds is in a range of 10% to 100% of a diameter of wire 110 and/or wore 120; in an embodiment distance Ds is in a range of 50% to 150% of a diameter of wire 110 and/or wore 120; in an embodiment distance Ds is in a range of 50% to 250% of a diameter of conductor 112 and/or conductor 122.

Joining or linking wires 110 and 120 via joining portion creates a number of advantages. For example, separating wires 110 and 120 by separation 342 inherently leaves a gap between conductors 112 and 122, and their respective soldering sections 116 and 126, that is greater than a gap that would exist if wires 110 and 120 were directly adjacent one another. This relatively large gap means that sections 116 and 126 do not need to be bent laterally as far apart to be able to fit illumination devices 130 therebetween. As such, stress on the conductors 112 and 122, including soldering sections 116 and 126 is reduced.

The embodiments above are intended to be illustrative and not limiting. Additional embodiments are within the claims. In addition, although aspects of the present invention have been described with reference to particular embodiments, those skilled in the art will recognize that changes can be made in form and detail without departing from the spirit and scope of the invention, as defined by the claims.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A light string, comprising:

a first illumination device, including a first substrate and a first light-emitting diode (LED) configured to emit light having a first color, wherein the first substrate includes a first carrier portion, a first anode soldering portion and a first cathode soldering portion, the first LED is disposed on the first carrier portion and the first anode soldering portion is electrically connected to an anode of the first LED and the first cathode soldering portion is electrically connected to a cathode of the first LED;

a second illumination device adjacent the first illumination device, including a second substrate and a second LED configured to emit light having a second color, the second color being different from the first color, wherein the first substrate includes a second carrier portion, a second anode soldering portion and a second cathode soldering portion, the second LED is disposed on the second carrier portion and the second anode soldering portion is electrically connected to an anode of the second LED and the second cathode soldering portion is electrically connected to a cathode of the second LED;

a first conductor having a first plurality of conductive strands and a first uninsulated portion, each of the first plurality of conductive strands electrically connected to the first anode soldering portion of the first LED at a first portion of the first uninsulated portion of the first conductor and to the second cathode soldering portion of the second LED at a second portion of the first uninsulated portion of the first conductor;

a second conductor positioned in parallel with the first conductor, the second conductor having a second plurality of conductive strands and a second uninsulated portion, each of the second plurality of conductive strands electrically connected to the first cathode soldering portion of the first LED at a first portion of the second uninsulated portion of the second conductor and to the second anode soldering portion of the second LED at a second portion of the second uninsulated portion of the second conductor;

a wire insulator portion commonly covering a first portion of the first conductor to form a first insulated portion of the first conductor and covering a first portion of the second conductor to form a second insulated portion of the second conductor, the wire insulator portion not covering the first uninsulated portion of the first conductor and not covering the second uninsulated portion of the second conductor, wherein the wire insulator portion comprises a generally flat, longitudinally and latitudinally joining portion between the first insulated portion of the first conductor and the second insulated portion of the second conductor, and defines a latitudinal width that is in a range of 10% to 100% of a diameter of the first insulated portion of the first conductor;

a first transparent material, commonly and entirely covering the first and second illumination devices, the first uninsulated portion of the first conductor and the second uninsulated portion of the second conductor, and partially covering the wire insulator portion.

2. The light string of claim 1, wherein the joining portion defines a latitudinal width that is in a range of 50% to 250% of a diameter of the first conductor.

3. The light string of claim 2, wherein the first illumination device and the second illumination device both face upward in a direction orthogonal to a direction of a lengthwise axis of the first wire and the second wire.

4. The light string of claim 1, further comprising a controller configured to provide a DC voltage to the first light source and the second light source, and to alternate a polarity of the provided DC voltage, such that either the first LED emits light or the second light source emits light, but not both the first light source and the second light source.

5. The light string of claim 4, wherein the controller comprises a processor and a memory storing instructions for powering the first light source and the second light source.

6. The light string of claim 1, further comprising soldering material that covers a portion of a lateral edge of the substrate.

7. The light string of claim 1, wherein the transparent material comprises a glue, and a hardness of the transparent covering is higher than a hardness of any portion of the first wire and the second wire.

8. The light string of claim 1, further comprising a third illumination device, a fourth illumination device, and a second transparent material, and wherein the third illumination device is adjacent to the fourth illumination device, the first conductor has a third uninsulated portion and the second conductor has a fourth uninsulated portion, and an anode of the third illumination device and a cathode of the fourth illumination device are electrically connected to the third uninsulated portion of the first conductor, and a cathode of the third illumination device and an anode of the fourth illumination device are electrically connected to the fourth uninsulated portion of the second conductor, and the second transparent material commonly and entirely covers the third and fourth illumination devices, the third uninsulated portion of the first conductor and the fourth uninsulated portion of the second conductor.

9. A light string, comprising:

a first illumination device, including a first substrate, a first light-emitting diode (LED) configured to emit light having a first color, and a second LED configured to emit light having a second color, the first color being different from the second color, wherein the first substrate includes a first carrier portion, a first soldering portion and a second soldering portion, and wherein the first and second LEDs are disposed on the first carrier, an anode of the first LED and a cathode of the second LED are connected to the first soldering portion, and a cathode of the first LED and an anode of the second LED are connected to the second soldering portion;

a first conductor having a first plurality of conductive strands and a first uninsulated portion, each of the first plurality of conductive strands electrically connected to the first soldering portion at a first portion of the first uninsulated portion of the first conductor;

a second conductor positioned in parallel with the first conductor, the second conductor having a second plurality of conductive strands and a second uninsulated portion, each of the second plurality of conductive strands electrically connected to the second soldering portion at a second uninsulated portion of the second conductor;

a wire insulator portion commonly covering a first portion of the first conductor to form a first insulated portion of the first conductor and covering a first portion of the second conductor to form a second insulated portion of the second conductor, the wire insulator portion not covering the first uninsulated portion of the first conductor and not covering the second uninsulated portion of the second conductor, wherein the wire insulator portion comprises a generally flat, longitudinally and latitudinally joining portion between the first insulated portion of the first conductor and the second insulated portion of the second conductor, and defines a latitudinal width that is in a range of 10% to 100% of a diameter of the first insulated portion of the first conductor;

a transparent material, commonly and entirely covering the first illumination device, the first uninsulated portion of the first conductor and the second uninsulated portion of the second conductor, and partially covering the wire insulator portion.

10. The light string of claim 9, wherein the joining portion defines a latitudinal width that is in a range of 50% to 250% of a diameter of the first conductor.

11. The light string of claim 10, wherein the first illumination device and the second illumination device both face upward in a direction orthogonal to a direction of a lengthwise axis of the first wire and the second wire.

12. The light string of claim 9, further comprising a controller configured to provide a DC voltage to the first light source and the second light source, and to alternate a polarity of the provided DC voltage, such that either the first LED emits light or the second light source emits light, but not both the first light source and the second light source.

13. The light string of claim 12, wherein the controller comprises a processor and a memory storing instructions for powering the first light source and the second light source.

14. The light string of claim 9, further comprising soldering material that covers a portion of a lateral edge of the substrate.

15. The light string of claim 9, wherein the transparent material comprises a glue, and a hardness of the transparent covering is higher than a hardness of any portion of the first wire and the second wire.

16. The light string of claim 9, further comprising a second illumination device and a second transparent material, and wherein the second illumination device comprises a third LED and a fourth LED, the first conductor has a third uninsulated portion and the second conductor has a fourth uninsulated portion, and an anode of the third LED and a cathode of the fourth LED are electrically connected to the third uninsulated portion of the first conductor, and a cathode of the third LED and an anode of the fourth LED are electrically connected to the fourth uninsulated portion of the second conductor, and the second transparent material entirely covers the second illumination devices, the third uninsulated portion of the first conductor and the fourth uninsulated portion of the second conductor.

* * * * *